US011649404B2

(12) United States Patent
Vaezi Ghobaeiyeh et al.

(10) Patent No.: US 11,649,404 B2
(45) Date of Patent: May 16, 2023

(54) ABLATION PROCESS FOR OIL SANDS SUBJECTED TO NON-AQUEOUS EXTRACTION

(71) Applicant: SUNCOR ENERGY INC., Calgary (CA)

(72) Inventors: Farid Vaezi Ghobaeiyeh, Calgary (CA); Ali Abbaspour, Calgary (CA); Jiayi Claire Cao, Calgary (CA); Iftikhar Huq, Calgary (CA); Brian Doucette, Calgary (CA)

(73) Assignee: SUNCOR ENERGY INC., Calgary (CA)

( * ) Notice: Subject to any disclaimer, the term of this patent is extended or adjusted under 35 U.S.C. 154(b) by 0 days.

(21) Appl. No.: 17/683,715

(22) Filed: Mar. 1, 2022

(65) Prior Publication Data

US 2022/0282161 A1 Sep. 8, 2022

(30) Foreign Application Priority Data

Mar. 5, 2021 (CA) ..... 3111420

(51) Int. Cl.
*C10G 1/04* (2006.01)

(52) U.S. Cl.
CPC ..... *C10G 1/045* (2013.01); *C10G 2300/44* (2013.01)

(58) Field of Classification Search
CPC ..... C10G 1/045; C10G 2300/04
See application file for complete search history.

(56) References Cited

U.S. PATENT DOCUMENTS 3,459,653 A * 8/1969 Benson ..... C10C 3/007 208/415
4,120,775 A * 10/1978 Murray ..... B03B 9/02 196/14.52

(Continued)

FOREIGN PATENT DOCUMENTS

CA 2937235 A1 * 9/2016 ..... C10G 1/045
CA 2937235 A1 9/2016

(Continued)

OTHER PUBLICATIONS

Cormack, D. et al., "Parameters and Mechanisms in the Solvent Extraction of Mined Athabasca Oil Sand", The Canadian Journal of Chemical Engineering vol. 55, Oct. 1977.

(Continued)

*Primary Examiner* — Randy Boyer
*Assistant Examiner* — Juan C Valencia
(74) *Attorney, Agent, or Firm* — WCF IP

(57) ABSTRACT

A non-aqueous extraction process for producing a bitumen product from an oil sands material that includes an ablation stage is provided. The ablation stage can include adding an ablation solvent to an oil sands material to achieve a solvent-to-ore ratio of less than about 10, mixing the ablation solvent and the oil sands material to reduce the size of the oil sands material and produce ablated ore that includes ablated ore fragments having a diameter of less than about 2 inches, and retrieving the ablated ore as a single stream. The ablated ore can be subjected to a reject separation stage to separate reject material therefrom. The reject material can also be subjected to a wash reject stage. The ablated ore can then be subjected to an extraction stage. Examples of ablators are also described, which can include for instance a conveyor, or can be a rotary screen ablator.

23 Claims, 15 Drawing Sheets

(56) References Cited

U.S. PATENT DOCUMENTS

| | | | | |
|---|---|---|---|---|
| 2012/0145602 | A1* | 6/2012 | Kift | C10G 1/04 208/435 |
| 2016/0102254 | A1* | 4/2016 | Cullinane | C10G 1/04 209/127.1 |
| 2021/0047569 | A1 | 2/2021 | Huq et al. | |

FOREIGN PATENT DOCUMENTS

| | | | |
|---|---|---|---|
| CA | 3016908 | A1 | 3/2020 |
| CA | 3051780 | A1 | 3/2020 |
| CA | 3051955 | A1 | 2/2021 |
| CA | 3090112 | A1 | 12/2021 |

OTHER PUBLICATIONS

Leung, H. and C. Phillips, "Solvent Extraction of Mined Athabasca Oil Sands," Ind. Eng. Chem. Fundam. vol. 24, 1985.
Meadus, F. W. et al., "Solvent Extraction of Athabasca Oil-Sand in a Rotating Mill", Fuel Processing Technology vol. 6 (1982).

* cited by examiner

ABLATION PROCESS FOR OIL SANDS SUBJECTED TO NON-AQUEOUS EXTRACTION

RELATED PATENT APPLICATION

This application claims priority from Canadian patent application No. 3,111,420, filed on Mar. 5, 2021, and titled "ABLATION PROCESS FOR OIL SANDS SUBJECTED TO NON-AQUEOUS EXTRACTION", the disclosure of which is hereby incorporated by reference in its entirety.

TECHNICAL FIELD

The technical field generally relates to processing mined oil sands, and more particularly to the extraction of bitumen from mined oil sands using non-aqueous extraction techniques.

BACKGROUND

Conventional methods for the extraction of bitumen from oil sands rely on mixing the oil sands with water to form an aqueous slurry and then separating the slurry into fractions including bitumen froth and aqueous tailings. The bitumen froth is then treated to remove residual water and solids, while the aqueous tailings are stored in tailings ponds and/or subjected to processing. Water-based extraction methods have various challenges related to water demand and processing requirements; energy requirements to heat aqueous streams to operating temperatures to facilitate extraction; as well as the production, handling and disposal of aqueous tailings materials.

SUMMARY

In accordance with an aspect, there is provided a non-aqueous extraction process for producing a bitumen product from an oil sands material comprising bitumen and solid mineral material, comprising:

- crushing oil sands ore to produce a crushed oil sands material;
- sizing the crushed oil sands material to produce a sized oil sands material;
- subjecting the sized oil sands material to an ablation stage, comprising:
  - adding an ablation solvent to the sized oil sands material to achieve a solvent-to-ore ratio of less than about 10;
  - mixing the ablation solvent and the sized oil sands material to further reduce the size of the sized oil sands material and produce ablated ore that comprises a mixture of dispersed sands and clay and ablated ore fragments, wherein a majority of the ablated ore fragments has a diameter of less than about 2 inches; and
  - retrieving the ablated ore as a single stream;
- subjecting the ablated ore to an extraction stage including adding a solvent-containing stream having a lower boiling point than bitumen to dissolve bitumen present in the ore fragments and facilitate extraction and separation of the bitumen from mineral solids in the ablated ore, thereby producing a solvent diluted bitumen stream comprising bitumen, solvent and fine mineral solids and a solvent diluted tailings stream comprising coarse mineral solids, bitumen and solvent;

- separating fine mineral solids from the solvent diluted bitumen stream to produce a solvent affected fine tailings stream and a bitumen enriched stream; and
- processing the bitumen enriched stream to produce a bitumen product.

In some implementations, the solvent-to-ore ratio ranges between about 0.25 and about 5.

In some implementations, the solvent-to-ore ratio ranges between about 0.25 and about 3.

In some implementations, the solvent-to-ore ratio ranges between about 0.25 and 2.

In some implementations, the solvent-to-ore ratio ranges between about 0.25 and about 1.

In some implementations, the solvent-to-ore ratio is less than about 1.

In some implementations, the diameter of the ablated ore fragments ranges between about 1 inches and about 2 inches.

In some implementations, the diameter of the ablated ore fragments ranges between about 0.5 inches and about 1 inches.

In some implementations, the diameter of the ablated ore fragments ranges between about 0.5 inches and about 2 inches.

In some implementations, the diameter of the ablated ore fragments is less than about 1 inch.

In some implementations, the diameter of the ablated ore fragments is less than about 0.5 inch.

In some implementations, the ablation solvent comprises an aliphatic solvent.

In some implementations, the aliphatic solvent comprises at least one of cyclohexane, cyclopentane, cycloheptane, and natural gas condensate.

In some implementations, the ablation solvent comprises a paraffinic solvent.

In some implementations, the paraffinic solvent comprises at least one of pentane, hexane, heptane, iso-pentane, iso-hexane, and iso-heptane.

In some implementations, the ablation solvent comprises partially deasphalted bitumen that is recycled from a downstream stage of the non-aqueous extraction process.

In some implementations, the ablation solvent comprises a recycled stream derived from the solvent diluted bitumen stream.

In some implementations, the process further comprises separating reject material from the ablated ore.

In some implementations, the process further comprises supplying a wash solvent to the reject material to recover residual bitumen therefrom.

In some implementations, the reject material comprises residual ablation solvent, and the process further comprises recovering the residual ablation solvent.

In some implementations, recovering the residual ablation solvent comprises stripping the residual ablation solvent.

In some implementations, the residual ablation solvent is present in an amount of less than about 5 wt % of the reject material.

In some implementations, the residual ablation solvent is present in an amount of less than about 1 wt % of the reject material.

In some implementations, the process further comprises a reject wash stage to wash the reject material and recover residual bitumen therefrom, the reject wash stage comprising supplying a wash solvent to the reject material to produce recovered residual bitumen and washed reject material.

In some implementations, the wash reject material comprises residual solvent, and the process further comprises recovering the residual solvent.

In some implementations, recovering the residual solvent comprises stripping the residual solvent.

In some implementations, the residual solvent is present in an amount of less than about 5 wt % of the reject material.

In some implementations, the residual solvent is present in an amount of less than about 1 wt % of the reject material.

In some implementations, the ablation stage is performed in an ablator that comprises a conveyor.

In some implementations, the conveyor comprises:

an ablator trough having an upstream end and a downstream end;

a rotating element operatively mounted within and longitudinally along the ablator trough, the rotating element comprising a shaft and a plurality of projections extending outwardly from the shaft;

a motor system coupled to the at least one rotating element for driving rotation thereof;

an ablated ore outlet provided for withdrawing the ablated ore; and an oil sands feed inlet for supplying the sized oil sands material to the conveyor.

In some implementations, the projections comprise discrete projections that extend radially and outwardly from the shaft.

In some implementations, the conveyor is operable in a co-current mode.

In some implementations, in the co-current mode, the ablated ore outlet is provided at the downstream end of the ablator trough and the oil sands feed inlet is provided at the upstream end of the ablator trough.

In some implementations, in the co-current mode, the ablation solvent is added at the upstream end of the ablator trough.

In some implementations, the conveyor is operable in a counter-current mode.

In some implementations, in the counter-current mode, the ablated ore outlet is provided at the downstream end of the ablator trough and the oil sands feed inlet is provided at the upstream end of the ablator trough.

In some implementations, in the counter-current mode, the ablation solvent is added at the downstream end of the ablator trough.

In some implementations, the process further comprises adding additional ablation solvent over the sized oil sands material at another location along a length of the ablator trough.

In some implementations, adding the ablation solvent to the sized oil sands material comprises distributing the ablation solvent over the sized oil sands material along a length of the ablator trough or a section of the length of the ablator trough.

In some implementations, distributing the ablation solvent over the sized oil sands material along the length of the ablator trough or a section of the length of the ablator trough comprises spraying the ablation solvent.

In some implementations, the process further comprises separating reject material from the ablated ore.

In some implementations, the reject material comprises residual ablation solvent, and the process further comprises recovering the residual ablation solvent.

In some implementations, the process further comprises supplying a wash solvent to the reject material to recover residual bitumen therefrom.

In some implementations, the conveyor further comprises a screen to separate the reject material from the ablated ore.

In some implementations, the screen comprises openings having an opening diameter larger than the diameter of the ablated ore fragments for the ablated ore fragments to pass therethrough.

In some implementations, the screen comprises openings having an opening diameter ranging between about 2 inches and about 6 inches.

In some implementations, the ablator trough comprises an upper region and a lower region, and the ablated ore is retrieved as the single stream from the lower region of the ablator trough.

In some implementations, separating reject material from the ablated ore comprises accumulating the reject material in the upper region of the ablator trough, with the reject material being receivable on an upper surface of the screen.

In some implementations, the process further comprises periodically retrieving the reject material from the upper region of the ablator trough.

In some implementations, the process further comprises a reject separation stage following the ablation stage to separate reject material from the ablated ore.

In some implementations, the reject material stage comprises supplying the ablated ore to a vibrating screen.

In some implementations, the reject material stage comprises supplying the ablated ore to a grizzly screen.

In some implementations, the reject material stage comprises supplying the ablated ore to a collection trap box.

In some implementations, the process further comprising a reject wash stage downstream of the reject separation stage to wash the reject material and recover residual bitumen therefrom, the reject wash stage comprising supplying a wash solvent to the reject material to produce recovered residual bitumen and washed reject material.

In some implementations, the reject material comprises residual solvent, and the process further comprises recovering the residual solvent from the reject material.

In some implementations, the washed reject material comprises residual solvent, and the process further comprises recovering the residual solvent from the washed reject material.

In some implementations, recovering the residual ablation solvent comprises stripping the residual ablation solvent.

In some implementations, the residual solvent is present in an amount of less than about 1 wt % of the reject material.

In some implementations, the residual solvent is present in an amount of less than about 5 wt % of the reject material.

In some implementations, the conveyor is operated at a pressure ranging from between about 80 psig and about 120 psig.

In some implementations, the conveyor is operated at a pressure about 15 psig above atmospheric pressure.

In some implementations, the ablation stage is performed in an ablation unit that comprises a rotary screen ablator.

In some implementations, the rotary screen ablator comprises:

a rotary drum configured for rotation about a longitudinal axis of the rotary screen ablator, the rotary drum comprising;

a rotary drum chamber having an upstream end and a downstream end; and openings distributed over the rotary drum, the openings being sized for enabling passage of the ablated ore therethrough while reject material remains inside the rotary drum chamber;

a closed horizontally extending cylindrical shell to contain vapours from the ablation solvent therein, the closed horizontally extending cylindrical shell comprising:

a bottom section configured to receive the ablated ore that passed through the openings, the bottom section comprising:

an ablated ore outlet for withdrawing the ablated ore therefrom; and an oil sands feed inlet for supplying the sized oil sands material into the chamber of the rotary drum.

In some implementations, the rotary drum comprises openings having an opening diameter larger than the diameter of the ablated ore fragments for the ablated ore fragments to pass therethrough.

In some implementations, the rotary drum comprises openings having an opening diameter ranging between about 2 inches to about 6 inches.

In some implementations, rotary screen ablator is operated to rotate at a rotational speed ranging between 1 rpm to 50 rpm.

In some implementations, the ablation solvent is added to the rotary drum by spraying the ablation solvent over tumbling sized oil sands material.

In some implementations, the ablation solvent is added to the rotary drum at the upstream end thereof, and the reject material is retrieved from the rotary drum from the downstream end thereof.

In some implementations, the process further comprises a reject wash stage to wash the reject material and recover residual bitumen therefrom, the reject wash stage comprising supplying a wash solvent to the reject material to produce recovered residual bitumen and washed reject material.

In some implementations, the reject material comprises residual solvent, and the process further comprises recovering the residual solvent from the reject material.

In some implementations, the washed reject material comprises residual solvent, and the process further comprises recovering the residual solvent from the washed reject material.

In some implementations, recovering the residual solvent comprises stripping the residual solvent.

In some implementations, the residual solvent is present in an amount of less than about 1 wt % of the reject material.

In some implementations, the residual solvent is present in an amount of less than about 5 wt % of the reject material.

In some implementations, the rotary screen ablator is operated at a pressure ranging from between about 80 psig and about 120 psig.

In some implementations, the rotary screen ablator is operated at a pressure about 15 psig above atmospheric pressure.

In accordance with another aspect, there is provided a non-aqueous extraction process for producing a bitumen product from an oil sands material comprising bitumen and solid mineral material, comprising:

a preparation treatment comprising at least an ablation stage, the ablation stage comprising:

adding an ablation solvent to the oil sands material to achieve a solvent-to-ore ratio of less than about 10;

mixing the ablation solvent and the sized oil sands material to further reduce the size of the sized oil sands material and produce ablated ore that comprises a mixture of dispersed sands and clay and ablated ore fragments, wherein a majority of the ablated ore fragments has a diameter of less than about 2 inches; and retrieving the ablated ore as a single stream;

subjecting the ablated ore to an extraction stage including adding a solvent-containing stream having a lower boiling point than bitumen to dissolve bitumen present in the ore fragments and facilitate extraction and separation of the bitumen from mineral solids in the ablated ore, thereby producing a solvent diluted bitumen stream comprising bitumen, solvent and fine mineral solids and a solvent diluted tailings stream comprising coarse mineral solids, bitumen and solvent;

separating fine mineral solids from the solvent diluted bitumen stream to produce a solvent affected fine tailings stream and a bitumen enriched stream; and processing the bitumen enriched stream to produce a bitumen product.

In some implementations, the oil sands material comprises crushed oil sands material.

In some implementations, the oil sands material comprises sized oil sands material.

In some implementations, the ablation solvent comprises an aliphatic solvent or a paraffinic solvent.

In some implementations, the ablation solvent comprises partially deasphalted bitumen that is recycled from a downstream stage of the non-aqueous extraction process.

In some implementations, the ablation solvent comprises a recycled stream derived from the solvent diluted bitumen stream.

In some implementations, the process further comprises separating reject material from the ablated ore.

In some implementations, the process further comprises a reject wash stage to wash the reject material and recover residual bitumen therefrom, the reject wash stage comprising supplying a wash solvent to the reject material to produce recovered residual bitumen and washed reject material.

In some implementations, the wash reject material comprises residual solvent, and the process further comprises recovering the residual solvent.

In some implementations, recovering the residual solvent comprises stripping the residual solvent.

In some implementations, the ablation stage and the extraction stage are performed in a common single unit.

In some implementations, the common single unit comprises:

a conveyor comprising:

a conveyor trough comprising:

an ablation zone configured for receiving the oil sands material, the ablation zone having an ablation upstream end and an ablation downstream end; and an extraction zone downstream of the ablation zone and in fluid communication therewith, the extraction zone having an extraction upstream end and an extraction downstream end;

a rotating element operatively mounted within and longitudinally along the conveyor trough, the rotating element comprising a shaft couplable to a motor for driving a rotation thereof and a plurality of projections extending outwardly from the shaft;

an oil sands feed inlet for supplying the oil sands material to the ablation zone of the conveyor trough; and a solvent diluted outlet provided at the ablation upstream end for withdrawing a solvent diluted bitumen stream;

wherein the ablated ore travels in a downstream direction to the extraction zone.

In some implementations, the ablation zone is between about 10% to about 60% of a total length of the conveyor trough.

In some implementations, the projections extending in the ablation zone and the projections extending in the extraction zone are similarly configured.

In some implementations, the projections extending in the ablation zone and the projections extending in the extraction zone are configured differently.

In some implementations, the conveyor is provided as an inclined conveyor in at least one of the ablation zone and the extraction zone.

In some implementations, the rotating element comprises multiple rotating elements arranged side-by-side relative to each other.

In some implementations, the ablation stage and the extraction stage are performed in separate units.

In some implementations, the ablation stage is performed in an ablator that comprises a conveyor, the conveyor comprising:

an ablator trough having an upstream end and a downstream end;

a rotating element operatively mounted within and longitudinally along the ablator trough, the rotating element comprising a shaft and a plurality of projections extending outwardly from the shaft;

a motor system coupled to the at least one rotating element for driving rotation thereof;

an ablated ore outlet for withdrawing the ablated ore; and an oil sands feed inlet for supplying the sized oil sands material to the conveyor.

In some implementations, the conveyor is operable in a co-current mode, with the ablated ore outlet is provided at the downstream end of the ablator trough and the oil sands feed inlet is provided at the upstream end of the ablator trough, and the ablation solvent is added at least at the upstream end of the ablator trough.

In some implementations, adding the ablation solvent to the sized oil sands material comprises distributing the ablation solvent over the sized oil sands material along a length of the ablator trough or a section of the length of the ablator trough.

In some implementations, the ablation stage is performed in an ablator that comprises a rotary screen ablator, the rotary screen ablator comprising:

a rotary drum configured for rotation about a longitudinal axis of the rotary screen ablator, the rotary drum comprising;

a rotary drum chamber having an upstream end and a downstream end; and openings distributed over the rotary drum, the openings being sized for enabling passage of the ablated ore therethrough while reject material remains inside the rotary drum chamber;

a closed cylindrical shell to contain vapours from the ablation solvent therein, the closed cylindrical shell comprising:

a bottom section configured to receive the ablated ore that passed through the openings, the bottom section comprising:

an ablated ore outlet for withdrawing the ablated ore therefrom; and an oil sands feed inlet for supplying the sized oil sands material into the chamber of the rotary drum.

In some implementations, the ablation solvent is added to the rotary drum by spraying the ablation solvent over tumbling sized oil sands material.

In some implementations, the ablation solvent is added to the rotary drum at the upstream end thereof, and the reject material is retrieved from the rotary drum from the downstream end thereof.

In some implementations, the rotary screen ablator is operated at a pressure about 15 psig above atmospheric pressure.

In accordance with another aspect, there is provided an ablator for producing ablated ore from an oil sands material, comprising:

a conveyor comprising:

an ablator trough configured for receiving the oil sands material, the ablator trough having an upstream end and a downstream end;

a rotating element operatively mounted within and longitudinally along the ablator trough, the rotating element comprising a shaft and a plurality of projections extending outwardly from the shaft;

a motor system coupled to the at least one rotating element for driving rotation thereof;

an ablated ore outlet provided for withdrawing the ablated ore therefrom; and an oil sands feed inlet for supplying the oil sands material into the ablator trough; and an ablation solvent inlet for supplying an ablation solvent to the ablator trough at a solvent-to-ore ratio of less than about 10;

wherein addition of the ablation solvent to the oil sands material and rotation of the rotating element reduces the size of the oil sands material and produces the ablated ore that comprises a mixture of dispersed sands and clay and ablated ore fragments, wherein a majority of the ablated ore fragments has a diameter of less than about 2 inches.

In some implementations, the projections comprise discrete projections that extend radially and outwardly from the shaft.

In some implementations, the projections comprise at least one of rods, baffles, blades, flights, and paddles.

In some implementations, the projections are provided in a helical configuration around the shaft.

In some implementations, the conveyor extends generally horizontally.

In some implementations, the conveyor is provided as an inclined conveyor.

In some implementations, the conveyor is provided at an angle of between about 0 degrees and about 45 degrees.

In some implementations, the rotating element comprises multiple rotating elements arranged in parallel.

In some implementations, the rotating element comprises a pair of rotating elements.

In some implementations, the pair of rotating elements are arranged in side-by-side relation to each other.

In some implementations, the rotating elements of the pair of rotating elements are configured to rotate in opposite directions.

In some implementations, the rotating elements of the pair of rotating elements are configured to rotate in a same direction.

In some implementations, the rotating element comprises a plurality of shaft segments, each shaft segment having a given configuration of the projections.

In some implementations, the projections are the same along the entire rotating element.

In some implementations, the oil sands feed inlet is provided at the upstream end of the ablator trough.

In some implementations, the ablated ore outlet is provided at the downstream end of the ablator trough.

In some implementations, the conveyor further comprises a screen to separate reject material from the ablated ore.

In some implementations, the screen comprises openings having an opening diameter larger than the diameter of the ablated ore fragments for the ablated ore fragments to pass therethrough.

In some implementations, the screen comprises openings having an opening diameter ranging between about 2 inches to about 6 inches.

In some implementations, the ablator trough comprises an upper region and a lower region, and the ablated ore outlet is provided in the lower region of the ablator trough for withdrawing the ablated ore therefrom as the single stream.

In some implementations, the screen is configured for accumulating the reject material in the upper region of the ablator trough, with the reject material being receivable on an upper surface of the screen.

In some implementations, the conveyor is configured as a sealed conveyor to contain vapours from the ablation solvent.

In some implementations, the ablator further comprises a heating system to heat frozen ore that forms part of the oil sands material.

In accordance with another aspect, there is provided an ablator for producing ablated ore from an oil sands material, comprising:

- a rotary screen ablator comprising:
  - a rotary drum configured for rotation about a longitudinal axis of the rotary screen ablator, the rotary drum comprising;
  - a rotary drum chamber having an upstream end and a downstream end; and
  - openings distributed over the rotary drum, the openings being sized for enabling passage of ablated ore therethrough while retaining reject material inside the rotary drum chamber; and
  - a closed horizontally extending cylindrical shell to contain vapours from the ablation solvent therein, the closed horizontally extending cylindrical shell comprising:
  - an oil sands feed inlet for supplying the oil sands material into the chamber of the rotary drum;
  - a bottom section configured to receive the ablated ore that passed through the openings, the bottom section comprising:
    - an ablated ore outlet for withdrawing the ablated ore therefrom; and
  - an ablation solvent inlet for supplying an ablation solvent at a solvent-to-ore ratio of less than about 10;
- wherein addition of the ablation solvent to the oil sands material and rotation of the rotary drum reduces the size of the oil sands material and produces the ablated ore that comprises a mixture of dispersed sands and clay and ablated ore fragments, wherein a majority of the ablated ore fragments has a diameter of less than about 2 inches.

In some implementations, the oil sands feed inlet is provided at the upstream end of the rotary drum.

In some implementations, the openings of the rotary drum have an opening diameter ranging between about 2 inches to about 6 inches.

In some implementations, the closed horizontally extending cylindrical shell further comprises a reject outlet for withdrawing the reject material from the rotary drum chamber.

In some implementations, the rotary screen ablator is configured as a sealed rotary screen ablator to contain vapours from the ablation solvent.

In some implementations, the ablator further comprises a heating system to heat frozen ore that forms part of the oil sands material.

In some implementations, the ablator comprises a plurality of rotary screen ablators provided in series.

In accordance with another aspect, there is provided a system for non-aqueous extraction of bitumen from an oil sands material, the system comprising:

- a conveyor comprising:
  - a conveyor trough comprising:
    - an ablation zone configured for receiving the oil sands material, the ablation zone having an ablation upstream end and an ablation downstream end;
    - an extraction zone downstream of the ablation zone and in fluid communication therewith, the extraction zone having an extraction upstream end and an extraction downstream end;
  - a rotating element operatively mounted within and longitudinally along the conveyor trough, the rotating element comprising a shaft couplable to a motor for driving a rotation thereof and a plurality of projections extending outwardly from the shaft;
  - an oil sands feed inlet for supplying the oil sands material to the ablation zone of the conveyor trough; and
  - a solvent diluted outlet provided at the ablation upstream end for withdrawing a solvent diluted bitumen stream;
- wherein the ablation zone is configured and operated to reduce the size of the oil sands material to produce ablated ore that comprises a mixture of dispersed sands and clay and ablated ore fragments, the ablated ore fragments having a diameter that is less than about 1 inch by the ablation downstream end;
- wherein the ablation zone is between about 10% to about 60% of a total length of the conveyor trough; and
- wherein the ablated ore travels in a downstream direction to the extraction zone.

In some implementations, the diameter of the ablated ore fragments is less than about 0.75 inch by the ablation downstream end.

In some implementations, the diameter of the ablated ore fragments is less than about 0.50 inch by the ablation downstream end.

In some implementations, the ablation zone is between about 10% to about 30% of a total length of the conveyor trough.

In some implementations, the ablation zone is between about 20% to about 40% of a total length of the conveyor trough.

In some implementations, the ablation zone is between about 40% to about 60% of a total length of the conveyor trough.

In some implementations, the projections comprise discrete projections that extend radially and outwardly from the shaft.

In some implementations, the projections comprise at least one of rods, baffles, blades, flights, and paddles.

In some implementations, the projections are provided in a helical configuration around the shaft.

In some implementations, the projections extending in the ablation zone and the projections extending in the extraction zone are similarly configured.

In some implementations, the projections extending in the ablation zone and the projections extending in the extraction zone are configured differently.

In some implementations, the conveyor extends generally horizontally.

In some implementations, the conveyor is provided as an inclined conveyor.

In some implementations, the conveyor is provided as an inclined conveyor in at least one of the ablation zone and the extraction zone.

In some implementations, the conveyor is provided at an angle of between about 0 degrees and about 45 degrees.

In some implementations, the rotating element comprises multiple rotating elements arranged in parallel.

In some implementations, the rotating element comprises a pair of rotating elements.

In some implementations, the pair of rotating elements are arranged in side-by-side relation to each other.

In some implementations, the rotating elements of the pair of rotating elements are configured to rotate in opposite directions.

In some implementations, the rotating elements of the pair of rotating elements are configured to rotate in a same direction.

In some implementations, the rotating element comprises a plurality of shaft segments, each shaft segment having a given configuration of the projections.

In some implementations, the ablation zone comprises one of the plurality of shaft segments, and the extraction zone comprises another one of the plurality of shaft segments.

In some implementations, the oil sands feed inlet is provided at the ablation upstream end of the conveyor trough.

In some implementations, the conveyor further comprises a screen provided in the ablation zone to separate reject material from the ablated ore.

In some implementations, the conveyor further comprises a screen provided in the extraction zone to separate reject material.

In some implementations, the screen comprises openings having an opening diameter larger than the diameter of the ablated ore fragments for the ablated ore fragments to pass therethrough.

In some implementations, the screen comprises openings having an opening diameter ranging between about 2 inches to about 6 inches.

In some implementations, the screen is configured for accumulating the reject material in an upper region of the conveyor trough in the ablation zone, with the reject material being receivable on an upper surface of the screen.

In some implementations, the screen is configured for accumulating the reject material in an upper region of the conveyor trough in the extraction zone, with the reject material being receivable on an upper surface of the screen.

In some implementations, the conveyor is configured as a sealed conveyor to contain vapours from the ablation solvent.

In some implementations, the system further comprises a heating system to heat frozen ore that forms part of the oil sands material.

In accordance with another aspect, there is provided a system for non-aqueous extraction of bitumen from an oil sands material, the system comprising:

- a conveyor comprising:
  - a conveyor trough comprising:
    - an ablation zone configured for receiving the oil sands material, the ablation zone having an ablation upstream end and an ablation downstream end, the ablation zone being configured and operated to reduce the size of the oil sands material to produce ablated ore that comprises a mixture of dispersed sands and clay and ablated ore fragments, the ablated ore fragments having a diameter that is less than about 1 inch by the ablation downstream end;
    - an extraction zone downstream of the ablation zone and in fluid communication therewith, the extraction zone having an extraction upstream end and an extraction downstream end, the extraction zone being configured and operated to produce an extracted bitumen and solids mixture;
  - a rotating element operatively mounted within and longitudinally along the conveyor trough, the rotating element comprising a shaft couplable to a motor for driving a rotation thereof and a plurality of projections extending outwardly from the shaft;
  - an oil sands feed inlet for supplying the oil sands material to the ablation zone of the conveyor trough; and
  - a solvent diluted outlet provided at the ablation upstream end for withdrawing a solvent diluted bitumen stream;
- a reject separation unit downstream of the extractor downstream end to separate the reject material from the extracted bitumen and solids mixture; and
- a classifier assembly provided downstream of the reject separation unit, the classifier assembly having a classifier upstream end and a classifier downstream end, the classifier assembly comprising:
  - a solvent inlet provided at the classifier downstream end for receiving a solvent containing stream into the classifier assembly.

In some implementations, the diameter of the ablated ore fragments is less than about 0.75 inch by the ablation downstream end.

In some implementations, the diameter of the ablated ore fragments is less than about 0.50 inch by the ablation downstream end.

In some implementations, the ablation zone is between about 10% to about 60% of a total length of the conveyor trough.

In some implementations, the ablation zone is between about 10% to about 30% of a total length of the conveyor trough.

In some implementations, the ablation zone is between about 20% to about 40% of a total length of the conveyor trough.

In some implementations, the ablation zone is between about 40% to about 60% of a total length of the conveyor trough.

In some implementations, the projections comprise discrete projections that extend radially and outwardly from the shaft.

In some implementations, the projections comprise at least one of rods, baffles, blades, flights, and paddles.

In some implementations, the projections are provided in a helical configuration around the shaft.

In some implementations, the projections extending in the ablation zone and the projections extending in the extraction zone are similarly configured.

In some implementations, the projections extending in the ablation zone and the projections extending in the extraction zone are configured differently.

In some implementations, the conveyor extends generally horizontally.

In some implementations, the conveyor is provided as an inclined conveyor.

In some implementations, the conveyor is provided as an inclined conveyor in at least one of the ablation zone and the extraction zone.

In some implementations, the conveyor is provided at an angle of between about 0 degrees and about 45 degrees.

In some implementations, the rotating element comprises multiple rotating elements arranged in parallel.

In some implementations, the rotating element comprises a pair of rotating elements.

In some implementations, the pair of rotating elements are arranged in side-by-side relation to each other.

In some implementations, the rotating elements of the pair of rotating elements are configured to rotate in opposite directions.

In some implementations, the rotating elements of the pair of rotating elements are configured to rotate in a same direction.

In some implementations, the rotating element comprises a plurality of shaft segments, each shaft segment having a given configuration of the projections.

In some implementations, the ablation zone comprises one of the plurality of shaft segments, and the extraction zone comprises another one of the plurality of shaft segments.

In some implementations, the oil sands feed inlet is provided at the ablation upstream end of the conveyor trough.

In some implementations, the reject separation unit comprises a screen or a gravity settler.

In some implementations, the screen comprises a vibrating screen.

In some implementations, the screen comprises a grizzly screen.

In some implementations, the screen comprises openings having an opening diameter larger than the diameter of the ablated ore fragments for the ablated ore fragments to pass therethrough.

In some implementations, the screen comprises openings having an opening diameter ranging between about 2 inches to about 6 inches.

In some implementations, the reject separation unit comprises a collection trap box.

In some implementations, the system is configured as a sealed system to contain vapours from the ablation solvent.

In some implementations, the system further comprises a heating system to heat frozen ore that forms part of the oil sands material.

DETAILED DESCRIPTION

Figure 1A:
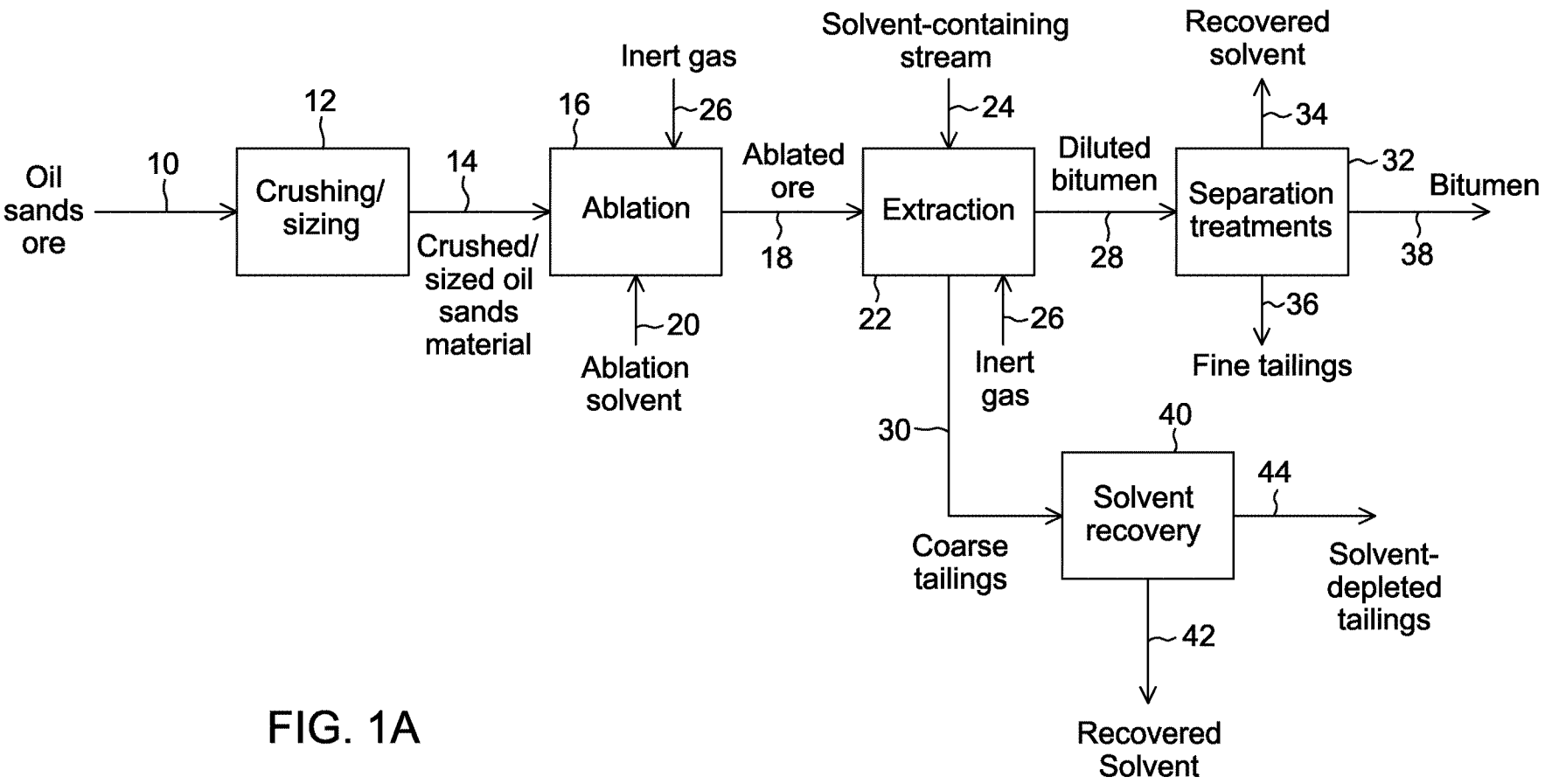
FIGS. 1A-1D are block diagrams of a process for extracting bitumen from oil sands, the process including an ablation stage.

Techniques described herein leverage the use of hydrocarbon solvent to extract bitumen from mined oil sands, and are directed more particularly to preparation treatments to prepare the oil sands ore for subsequent steps of extraction and separation. The preparation treatment can include an ablation stage for producing ablated ore having certain characteristics that facilitate the subsequent extraction and separation of bitumen from the oil sands. The ablation stage can include adding an ablation solvent to the oil sands material at a given a solvent-to-ore ratio, mixing the ablation solvent and the oil sands material, for instance in an ablator having rotating components to facilitate the ablation and conveyance of the material, to reduce the size of the sized oil sands material and produce ablated ore that comprises a mixture of dispersed sands and clay and ablated ore fragments, and retrieving the ablated ore as a single stream for subsequently subjecting the ablated ore to a non-aqueous extraction stage.

Non-aqueous extraction (NAE) of bitumen can be carried out using a low boiling point organic solvent that has a high solubility for bitumen and allows easy separation from the bitumen after extraction. The solvent containing stream added to the oil sands for extraction can include both solvent as well as bitumen or bitumen derived materials, and can be referred to as "solbit". It is also noted that the term "solbit" can be used in the context of other streams and zones present in vessels that include a mixture of solvent and bitumen. The solid mineral materials from which bitumen is extracted can be disposed readily into a mine pit as reclamation material, thereby facilitating mine reclamation and significantly reducing tailings management requirements.

Non-aqueous extraction of bitumen with hydrocarbon solvents has potential for processing a broad range of oil sands ore qualities (e.g., 5 wt %-13 wt % bitumen), producing dry trafficable tailings material with less land disturbance, and lowering green house gas (GHG) emissions per barrel of bitumen compared to aqueous extraction techniques.

Various enhancements and advantageous techniques are described herein in the context of non-aqueous extraction of bitumen from oil sands ore. In particular, treatments performed to prepare the oil sands ore that is subsequently subjected to a solvent extraction stage are detailed in the following paragraphs.

Overall Non-Aqueous Extraction Process

Referring to FIGS. 1A-1D, the process includes mining oil sands ore 10 and subjecting the ore to a crushing/sizing stage 12 to produce a crushed/sized oil sands material 14 that is then supplied to an ablation stage 16. The crushing/sizing stage 12 can be configured to prepare the ore for the ablation stage 16, by mechanically reducing the size of the lumps of the mined oil sands ore 10 to produce the crushed/sized oil sands material 14.

The crushing/sizing stage 12 can use any type of dry crushing and dry sizing methods with or without screens to remove lumps that are larger than a given ore lump size. In some implementations, the crushing and sizing of the oil sands is performed dry in the sense that no water or solvent is added during the crushing and sizing stages. Alternatively, the crushing and/or sizing may be done with the addition of small amounts of solvent or water, which can be referred to as wet crushing. The wet crushing can produce smaller lump size ranges than dry crushing, which can help ablation. Following the crushing and sizing, an ore feeding system can be provided to store and transfer the crushed ore to the ablation stage 16. The ore preparation system can be configured for replacing interstitial oxygen in the bed of ore lumps with an inert gas to reduce the oxygen concentration to less than 5%, less than 2%, or less than 1%. Replacing the interstitial oxygen with an inert gas, which can be referred to as deoxygenation of ore, can limit the ingress of oxygen to the ablation stage 16 or the extraction stage 12, which in turn can prevent flammable conditions within the ablation stage 16 and the extraction stage 12. The inert gas at a given pressure can also prevent egress and leak of solvent vapors from the ablation stage 16 or the extraction stage 12 to the surroundings. The inerting gas can be any type of gas, such as but limited to, nitrogen, carbon dioxide, and natural gas.

Figure 2:
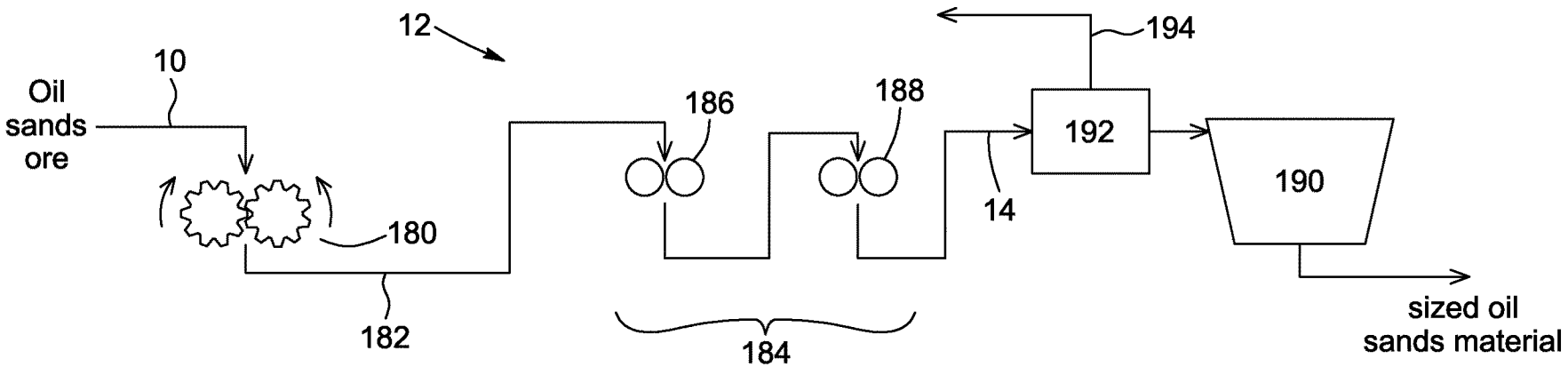
FIG. 2 is a block diagram of a process for preparing oil sands ore for processing, including crushing and sizing prior to ablation.

FIG. 2 illustrates an implementation of a crushing/sizing stage 12 that can be performed to produce the crushed/sized oil sands material 14. In this implementation, the mined oil sands ore 10 is fed from an apron feeder or a feed conveyor into a primary crusher 180 that can include a pair of opposed drums with projections and configured to rotate in opposing directions so as to receive and crush the ore 10. The primary crusher 180 can be a stationary, periodically movable or mobile type unit. The primary crusher 180 produces a crushed ore 182 that can be delivered by conveyor, for example, to the next unit operation.

The crushed ore 182 can be fed to a sizing stage 184. The sizing stage 184 can include one or more units that convert the crushed ore 182 into a more uniform and smaller sized feed material for downstream processing. The sizing can be done as dry sizing (i.e., with little to no added liquid) or wet sizing (i.e., with some added hydrocarbon liquid selected for compatibility with downstream processing and safety considerations). In some implementations, the sizing units can include a secondary double roll sizer 186 and a tertiary double roll sizer 188, which can be referred to as such since the primary crusher 180 does perform some ore sizing. The crushed/sized oil sands material 14 can then be fed into a hopper 190 prior to being supplied to downstream processing.

It should also be noted that other units can be used for crushing and/or sizing the mined oil sands ore 10 and for providing the sized/crushed oil sands material 14. For example, in one alternative, at least one double roll sizer can be used to size the oil sands material which can then fed through a screen 192 in order to produce a uniform sized material passing through the screen 192, and oversized material 194 that can be recycled back into one of the upstream sizers or the crusher for size reduction.

In the context of the non-aqueous extraction processes described herein, the target size of the lumps of the crushed/sized oil sands material 14 can be between about 20 inches to about 8 inches, for example. In some implementations, the target size of the lumps of the crushed/sized oil sands material 14 can be between about 16 inches to about 6 inches, between about 10 inches to about 6 inches, or between about 8 inches to about 4 inches. The crushing/sizing stage 12 can be configured such that the lump size of the crushed/sized oil sands material 14 is adequate for enhanced performance of the ablation stage 16. For instance, in some implementations, the ablation stage 16 can be configured to receive a crushed/sized oil sands material 14 that includes lumps that are smaller than about 16 inches, than about 10 inches, or than about 8 inches, and the crushing/sizing stage 12 will be operated accordingly. In other implementations, the ablation stage 16 can be configured to receive a crushed/sized oil sands material 14 that includes lumps that are smaller than about 6 inches, and the operation of the crushing/sizing stage 12 will be adjusted to provide this size of lumps to the ablation stage 16.

The crushed ore 14 is subjected to an ablation stage 16 to produce ablated ore 18. An ablation solvent-containing stream 20 is supplied to the ablation stage 16 to contact the crushed/sized oil sands material 14. More details regarding the ablation stage 16 are provided below.

The ablated ore 18 is then introduced into a non-aqueous extraction stage 22 where a solvent-containing stream 24, such as a hydrocarbon solvent, facilitates extraction of the bitumen from the mineral solids that make up the oil sands ore. Regarding the extraction stage 22, it can be an integrated stage that enables multiple features including digestion of the ore, extraction of the bitumen from the mineral solids, and separation of the solvent and bitumen from the mineral solids. In some implementations, this extraction stage 22 can be referred to as a digestion/extraction/separation stage that is implemented in a single unit, although it should be noted that other implementations of the process may enable the operations of digestion, extraction and separation in multiple distinct units. The extraction stage 22 produces solvent diluted bitumen 28 and solvent diluted coarse tailings 30.

The solvent-containing stream 24 is supplied to the extraction stage 22 to dilute the bitumen and promote extracting and separation of the bitumen from the mineral solids. The solvent-containing stream 24 includes a hydrocarbon solvent that can be selected to be more volatile than the bitumen to facilitate downstream separation and recovery of the solvent. The solvent-containing stream 24 can be derived from one or more downstream unit and can include a predominant portion of solvent and a minor portion of bitumen (which can be referred to as "solbit"). The solvent-containing stream 24 can be a combination of several downstream fluids that include different proportions of solvent.

An inert gas 26 can also be delivered to the extraction stage 22 and associated units to displace any oxygen or maintain pressure to prevent in-leakage.

In some implementations and as will be discussed further below, the ablation stage 16 and the extraction 16 can be combined and be performed in a common equipment.

There are a number of different process configurations and equipment designs that can be used to perform the digestion, extraction and separation operations of the extraction stage 22. Before describing particular process and system implementations, general comments regarding digestion, extraction and separation will be described below.

"Digestion" can be considered to involve disintegrating the lumps in the sized oil sands material to smaller and smaller sizes using shear based means or a combination of mechanical, attrition, fluid, thermal, and chemical energy inputs, with the aim of providing a digested material where the lumps are reduced to individual grains that are coated with bitumen. Breaking down the adherence between the solid mineral grains can involve shearing with dynamic or static mixer devices and/or mobilization of interstitial bitumen using heat or solvent dissolution.

"Extraction" can be considered to involve dissociating bitumen from the mineral solids to which the bitumen is adhered. Bitumen is present in the interstices between the mineral solid particles and as a coating around sand and clay particles. Extraction entails reducing the adherence of the bitumen to the solid mineral materials so that the bitumen is no longer intimately associated with the minerals. Effective ablation and digestion enhance extraction since more of the bitumen is exposed to extraction conditions, such as heat that mobilizes the bitumen and solvent that dissolves and mobilizes the bitumen. Effective extraction, in turn, aims to enhance separation performance in terms of maximizing recovery of bitumen from the oil sands ore and minimizing the bitumen that reports to the tailings. In commercial implementations, the target extraction level is typically at least 90 wt % of the bitumen present in the oil sands material, although other extraction levels or thresholds can be used.

"Separation" in this context can be considered to involve removing the extracted bitumen from the mineral solids, forming a distinct stream or material that is enriched in bitumen and depleted in solid mineral material. Separation mechanisms can include gravity separation in which density differences cause lighter solvent diluted bitumen to rise while heavier solid mineral material sinks within a vessel. In separation, there is a displacement of bitumen enriched, solids depleted material away from bitumen depleted, solids enriched material. In the context of FIGS. 1A-1D, for example, the separation results in the production of the solvent diluted bitumen 28 and the solvent diluted coarse tailings 30. Solbit tends to have a low density and viscosity compared to water based separation methods, which are enhanced attributes for separation.

While digestion, extraction and separation are described above as distinct phenomena, they can of course occur to some degree simultaneously within a given vessel or unit. For example, if a feed stream of sized oil sands ore were fed into a conventional gravity separation cell, there would be some degree of digestion from fluid movement and contact with the separation cell walls; extraction of bitumen from small particulate material and from the external parts of non-digested lumps; and separation of bitumen extracted from solids by gravity settling mechanisms. However, in such a scenario, there may be insufficient digestion of lumps to enable extraction of target quantities of bitumen from the oil sands ore, such that the overall separation performance would be uneconomical.

In some implementations, the extraction stage 22 is designed and operated such that digestion, extraction and separation are performed in a single unit, which can be referred to generally as an "integrated extraction unit". Alternatively, distinct or standalone units can be used for performing these operations (i.e., a digestion unit followed by an extraction unit, and then followed by a separation unit). In addition, a standalone unit can be combined with an integrated unit (e.g., a standalone digestion unit followed by an integrated extraction and separation unit). For the integrated extraction unit, there are a number of possible designs and implementations, which will be described in more detail below.

Figure 3:
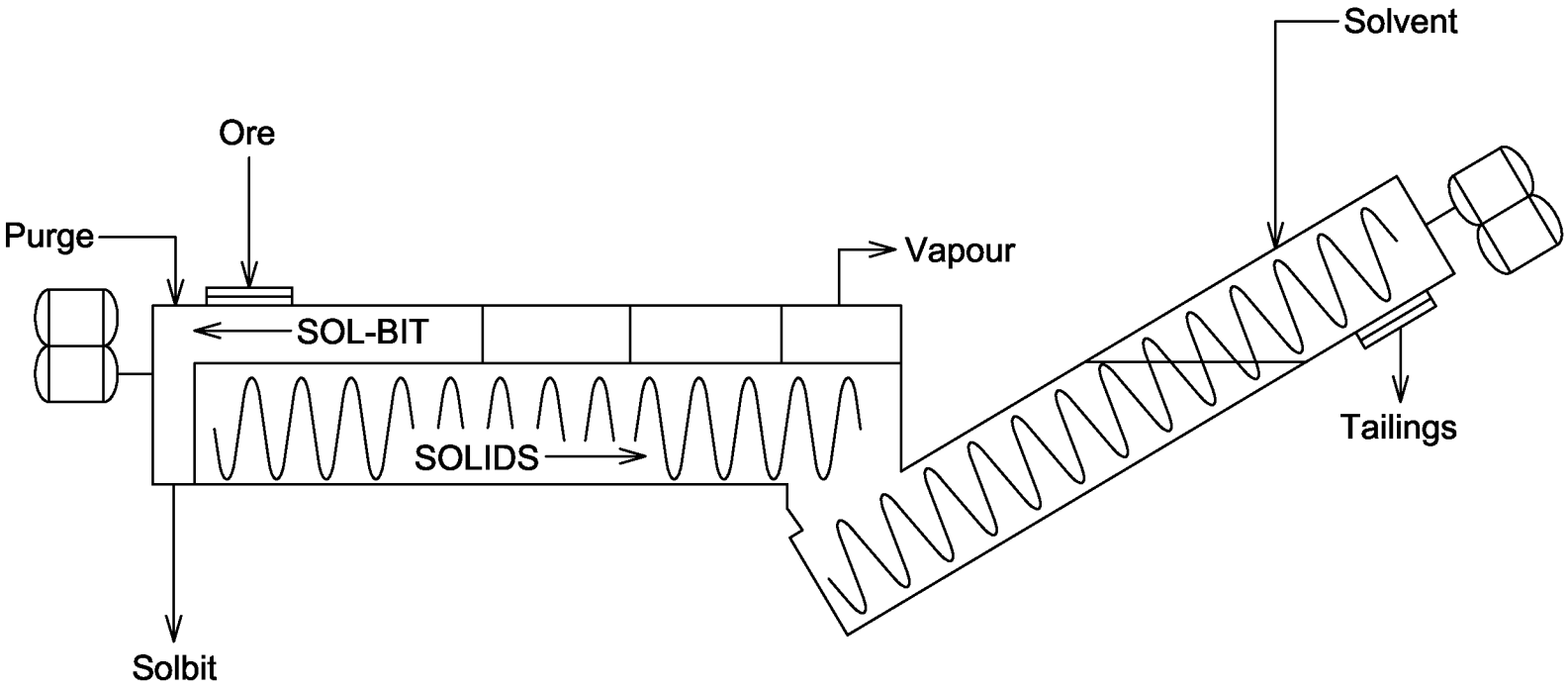
FIG. 3 is an example of an extraction assembly that includes a rotating element received in an extractor trough and a classifier assembly, the extraction assembly being configured for extracting bitumen from oil sands.

In some implementations, the extraction stage 22 can be performed using an extractor or an extraction assembly that includes a "log washer" as described in detail in Canadian application No. 3,051,780, which is incorporated herein by reference, although various other extractor vessels can be used. Briefly, the extraction assembly can include at least one rotating element received in an extractor trough and that rotates about its longitudinal axis, the rotating element including a longitudinal shaft and elements extending outwardly from the longitudinal shaft to provide high mixing energy while advancing the solids along the extractor trough, to facilitate digestion and extraction of bitumen from the oil sands ore 10. The bed of solids is moved along the extractor trough in one direction by the rotating elements, while liquid solbit layer above the bed moves countercurrently with respect to the bed and can be recovered as overflow from the extractor trough. The extraction assembly can also include an inclined classifier assembly having a lower upstream end fluidly connected to the downstream end of the extractor trough. The classifier assembly includes at least one auger that receives the solids advanced by the log washer and transports the solids upwardly while a solvent-containing stream is added into an upper part of the classifier assembly to enable back drainage and washing of the solids prior to discharge as solvent diluted tailings 30. The solvent-containing stream added to the classifier drains downward as it dissolves bitumen and then forms part of the liquid solbit layer that moves through the extractor trough. It is noted that the above description of the extraction assembly is only one example of possible extraction assemblies that can be implemented to perform the extraction stage 22, of which an illustration is shown in FIG. 3, and that any one of the embodiments of an extractor for as described in Canadian application No. 3,051,780 can be implemented as part of the extraction stage 22, as well as any other assembly enabling the extraction of bitumen from oil sands implementable in the context of NAE processes. Overall, the extraction stage 22 is configured to enable some digestion of the ore, extraction of the bitumen from the mineral solids, and separation of solvent and bitumen from the mineral solids. In some implementations, the extraction stage 22 can be implemented in a single unit or in multiple distinct units that may be arranged in series.

The equipment for performing the extraction stage 12 can include inlets and outlets to enable the addition of the ablated ore 18 and solvent-containing stream 24 as well as the removal of the solvent diluted bitumen 28 and the solvent diluted coarse tailings 30. In some implementations, the solvent diluted bitumen 28 and the solvent diluted coarse tailings 30 can be removed as overflow and underflow streams, respectively, but various other arrangements are also possible. The inlets and outlets of the equipment for performing the extraction stage 22 can be provided and located depending to the equipment design. The extraction stage 22 can also be operated so that the ablated ore 18 and the solvent-containing stream 24 are mixed with sufficient energy and for a sufficient period of time to extract at least 90% of the bitumen or at least 91%, 92%, 93%, 94% or 95%, by weight, of the bitumen. The shear and mixing can also be provided in order to mitigate the suspension of fines in the solvent diluted bitumen 28.

Still referring to FIGS. 1A-1D, the solvent diluted bitumen 28 is subjected to additional separation treatments 32 including solvent recovery to obtain recovered solvent 34 for reuse in the process, fine tailings 36 composed mainly of fine mineral solids less than 44 microns as well as residual solvent and bitumen, and bitumen 38. The bitumen 38 can include some solvent and residual contaminants, and can be subjected to further processing, such as deasphalting and refining.

Still referring to FIGS. 1A-1D, the solvent diluted coarse tailings 30 can also be subjected to further treatments, such as solvent recovery 40 to produce tailings recovered solvent 42 and solvent depleted tailings 44.

Figure 1B:
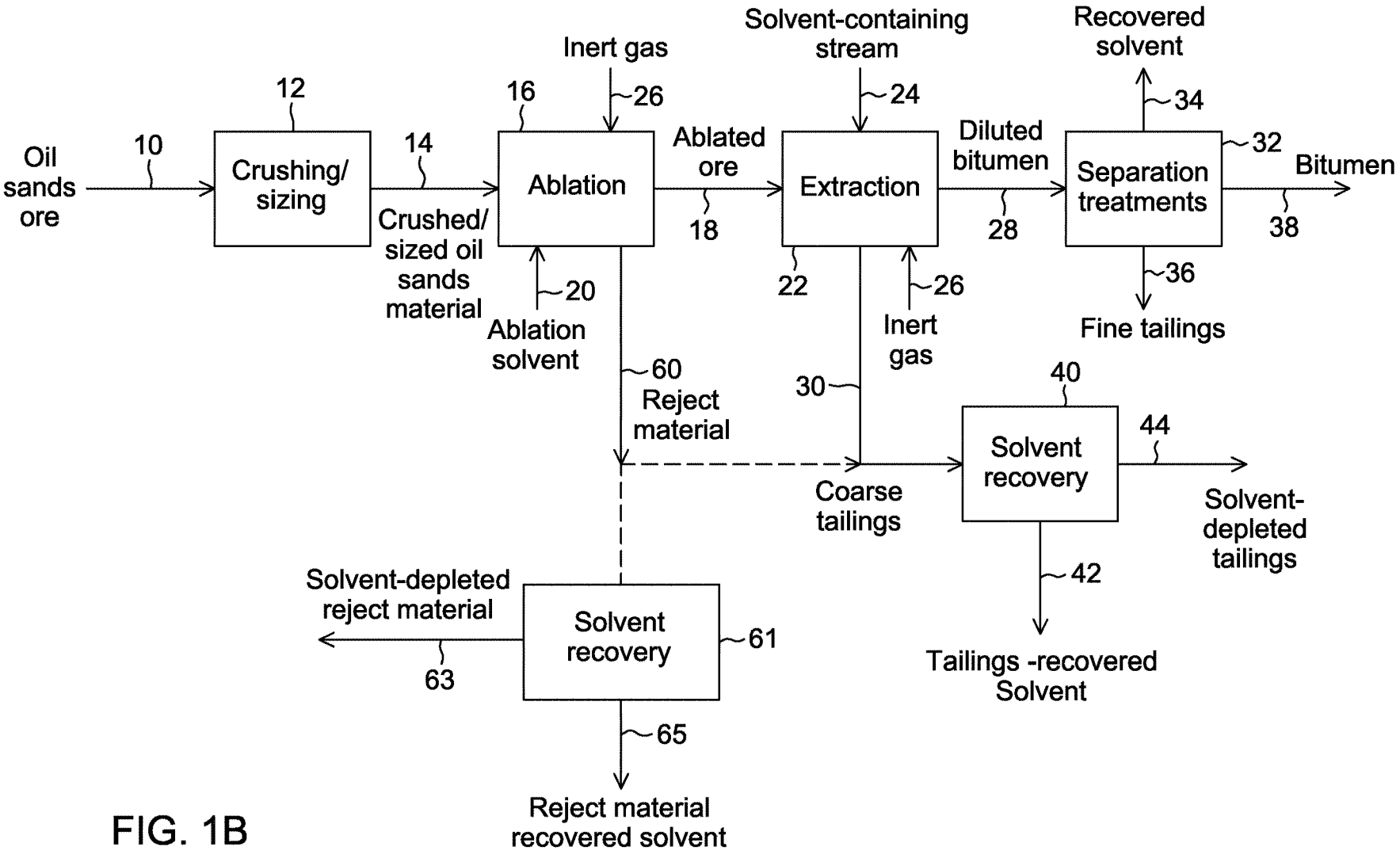
Figure 1C:
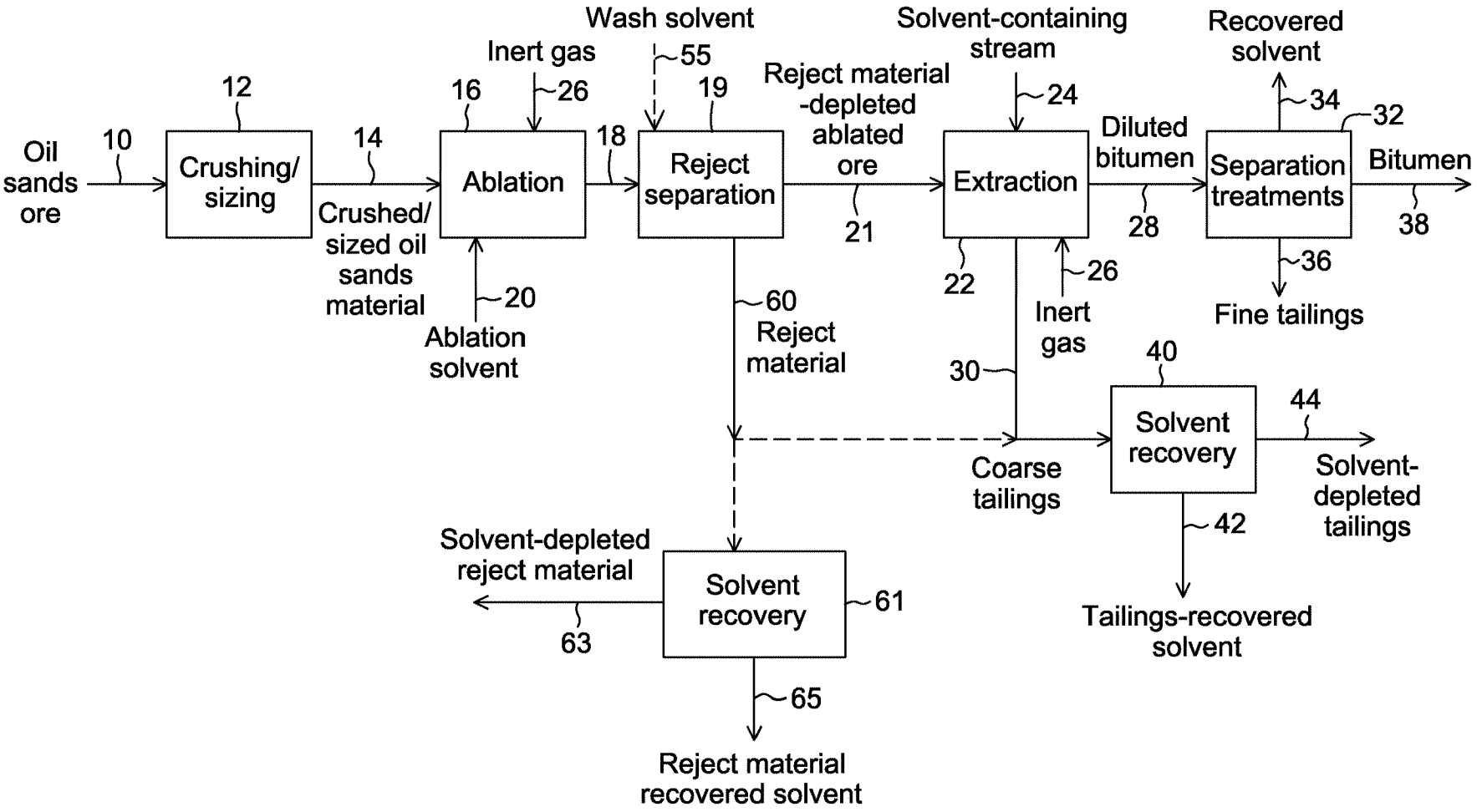

Referring now to FIG. 1B, in some implementations, reject material 60 can be retrieved during the course of the ablation stage 16 and be subjected to solvent recovery 61 to produce a solvent-depleted reject material 63 and reject material recovered solvent 65. Alternatively, the reject material 60 can be combined with the coarse tailings 30 to form a combined stream of reject material and coarse tailings, and the combined stream of reject material and coarse tailings can be subjected to solvent recovery 40 to produce the tailings-recovered solvent 42 and the solvent-depleted tailings 44.

Alternatively and with reference to FIG. 10, in other implementations, the ablated ore 18 from the ablation stage 16 can include reject material and be subjected to a reject separation stage 19 prior to being subjected to the extraction stage 22. In this implementation, the reject separation stage 19 produces a reject material-depleted ablated ore 21 that is subjected to the extraction stage 22, and reject material 60. Similarly to the implementation shown in FIG. 1B, the reject material 60 from the reject separation stage 19 can be subjected to solvent recovery 61 to produce a solvent-depleted reject material 63 and reject material recovered solvent 65. Alternatively, the reject material 60 can be combined with the coarse tailings 30 to form a combined stream of reject material and coarse tailings, and the combined stream of reject material and coarse tailings can be subjected to solvent recovery 40 to produce the tailings-recovered solvent 42 and the solvent-depleted tailings 44.

The addition of a reject separation stage 19 that is distinct from the ablation stage 16, i.e., that is performed in a distinct equipment than the equipment used for performing the ablation stage 16, can depend for instance on the equipment used to perform the ablation stage 16. For instance, when the ablation stage 16 is performed in a rotary screen breaker, the reject separation stage 19 can be omitted since the rotary screen breaker can already be configured to separate the reject material 60 from the ablated ore 18 during operation. On the other hand, even when the equipment used for performing the ablation stage 16 can separate reject material 60 from the ablated ore 18, such as when performing the ablation stage 16 using a rotary screen breaker, it may still be desirable to include a reject separation stage 19 downstream of the ablation stage 16, for instance to separate reject material having a smaller size. When the equipment used for performing the ablation stage 16 includes for instance a conveyor, the conveyor may or may not be configured to separate reject material during operation. When the conveyor is not configured to separate the reject material during operation, then it can be beneficial to include a reject separation stage 19 downstream of the ablation stage 16.

Figure 1D:
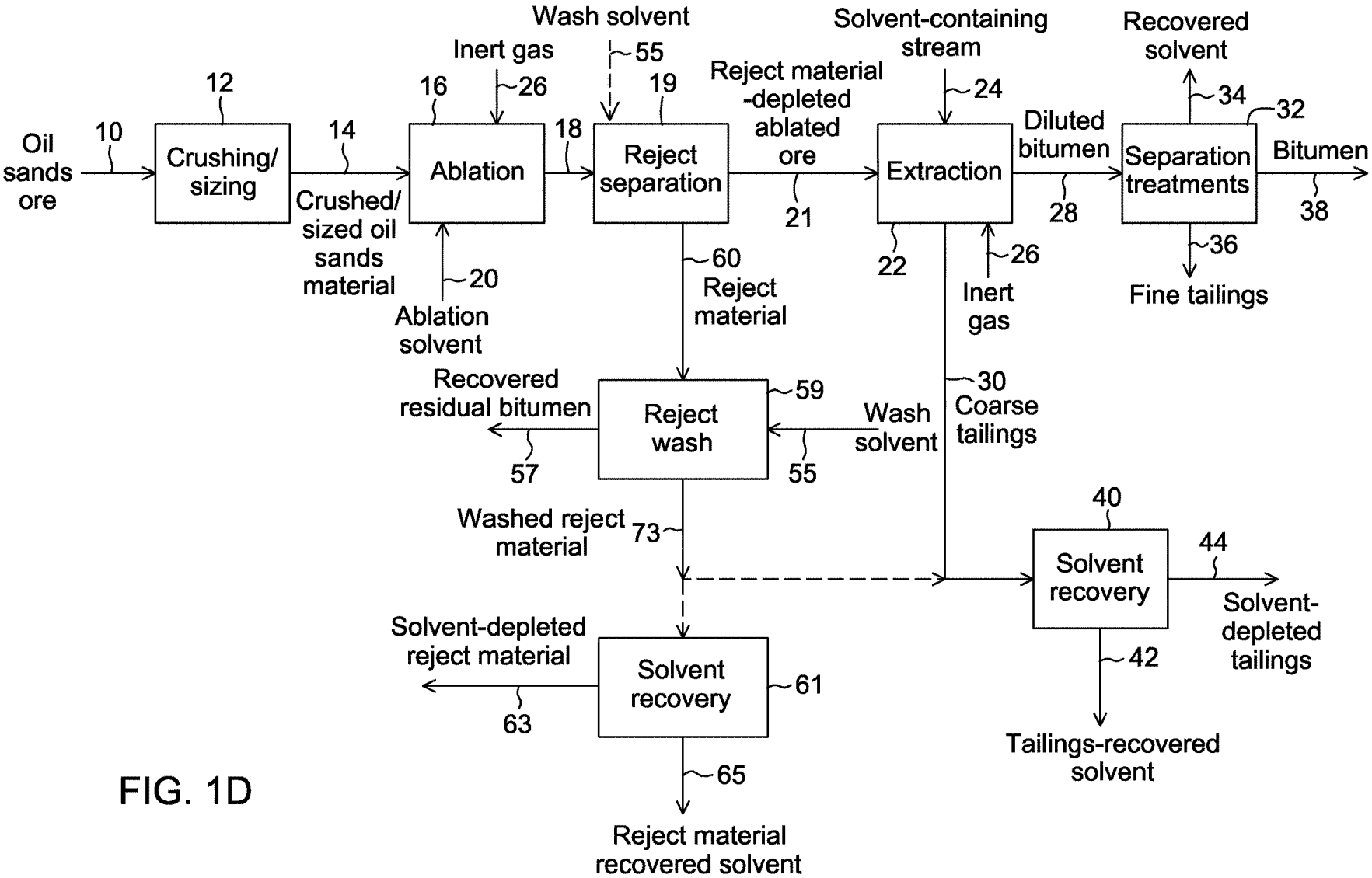

Referring now to FIG. 1D, the process can include a reject wash stage 59 downstream of the rejection separation stage 19. The reject wash stage 59 can enable recovering residual solvent diluted bitumen that may be present in the reject material 60. A wash solvent 55 is supplied to the reject wash stage 59, to produce a stream of recovered residual bitumen 57 and washed reject material 73. The wash solvent 55 can be sprayed over the reject material, or supplied thereto in any other suitable manner. The wash solvent 55 can be the same or be different than the ablation solvent 20. In addition, whether a reject wash stage 59 is provided downstream of the reject separation stage 19 or not, wash solvent 55 can be optionally supplied to the reject separation stage 19 to recover solvent diluted bitumen and increase overall bitumen recovery.

Ablation Stage Implementations

The ablation stage 16 as well as associated equipment will now be described in further detail. While various examples and implementations will be described, it should be understood that alternative structures and operating features can also be used for ablation of the oil sands material prior to subsequent steps of the NAE operation.

As used herein, the term "ablation" can refer to the disintegration of oil sands lumps of the oil sands material, such as crushed/sized oil sands material 14, into grain-sized material and smaller oil sands lumps fragments. While in some implementations, ablation, digestion, and extraction can occur simultaneously, these phenomena can be characterized and distinguished by the range the sizes of the oil sand material. For instance, ablation can refer to an initial stage of disintegration of large oil sands lumps to smaller fragments, and digestion can refer to the continuation of ablation where smaller lump fragments are further disintegrated to much smaller fragments and fully dispersed sands and clays. During both ablation and digestion, bitumen within the oil sands material can be partially or fully dissolved in the ablation solvent.

In some implementations, ablation can be referred to as the disintegration of oil sands lumps having a diameter that is less than about 16 inches, less than about 10 inches, less than about 8 inches, less than about 6 inches, or less than about 4 inches, to ablated ore fragments having a diameter that is less than about 2 inches, less than about 1 inch, less than about 0.75 inch, or less than about 0.5 inch. Digestion can refer to the disintegration of ablated ore fragments having a diameter that is less than about 2 inches, about 1 inch, about 0.75 inch, or about 0.5 inch to mostly dispersed grain-sized materials that are mainly sands and clays having a diameter that is less than about 0.5 inch, less than about 0.1 inch, less than about 0.01 inch, or less than about 0.001 inch with some bitumen adhered to their surfaces. Partial ablation can also occur, in which case a mixture of grain-sized material and fragmented lumps that are 2 to 10 times smaller than the size of the crushed/sized oil sands material 14 is produced. In some implementations, a majority of the ablated ore fragments has a diameter of less than about 2 inches. In this context, the expression "a majority" can refer to more than 50% of the ablated ore fragments that has a diameter of less than about 2 inches.

Before being fed into the ablation stage 16, the crushed/sized ore material 14 can be inerted to displace and remove oxygen therefrom, by supplying an inert gas to the one or more ablation unit performing the ablation stage 16.

The ablation stage 16 performed in the context of an NAE process can produce a mixture of two phases, i.e., a first phase that includes mainly bitumen dissolved in solvent, and a second phase that includes mainly solids, the first and second phase forming together the ablated ore 18, which can be in the form of a slurry. The formation of these two phases is different than conventional water-based oil sands ablation and extraction processes in which three phases are formed, i.e., a first phase made of bitumen froth, which corresponds to a mixture of bitumen, water, air, and some fines; a second phase that includes mainly mineral solids; and a third phase that includes mainly water and some fines.

Three main mechanisms can be considered to be involved in the ablation:

dissolution ablation, shear ablation and mechanical ablation. Dissolution ablation refers to a size reduction by dissolution of bitumen into solvent, which plays a notable role in the disintegration and ablation of ore lumps. Shear ablation, also called peeling ablation, refers to a size reduction due to internal movement of bitumen inside a lump, resulting in loss of macroscopic layers of the lump from the surface of the lump, like peeling. Heating of the lumps with a warm ablation solvent can accelerate the peeling ablation by decreasing the viscosity of bitumen within the lumps. Heating of the lumps can be useful when subjecting a frozen oil sands material to ablation such as during winter season. Mechanical ablation is due to attrition forces and impact forces resulting from the contact of a lump with other lumps, with the mechanical components in the ablation unit and/or with the walls of the ablation unit.

In some implementations, the mined oil sands ore 10 can be contacted with a small amount of solvent prior to introduction into the ablation stage 16. This can be viewed as a solvent moistening pre-treatment of the oil sands material, which enables the solvent to begin to penetrate and dissolve with the bitumen in the pores of the oil sands, and thus facilitate disintegration as lumps become easier to break down. A solvent containing stream can be sprinkled or sprayed onto the oil sands material, and can be formulated to have a composition to minimize vaporization of the solvent (e.g., higher bitumen content in the solvent stream). The pre-moistening can be done in various units upstream of the extractor and such units would be sealed and inerted. For example, the solvent could be added into a holding vessel and/or a conveyor. These units would also be connected to a vapour recovery and management system, which could also be connected to other units in the overall process. The addition of solvent can also increase the pressure within the sealed vessel or conveyor or other upstream unit, which can also reduce air ingress. The solvent that is added for pre-moistening can be part of a solbit stream that is formulated for that particular purpose and/or may include hydrocarbon fractions generated in downstream bitumen processing operations. For instance, this solbit stream can have higher bitumen content. The solbit stream can be prepared to have particular properties for spraying via a particular nozzle configuration to induce specific fluid dynamics conditions and achieve a desired spray pattern.

In the ablation unit, the crushed/sized ore material 14 is contacted, or mixed, with an ablation solvent 20, which can be referred to as an ablation liquor, to produce the ablated ore 18. The ablation solvent 20 can be the same or can be different from the solvent-containing stream 24 supplied to the extraction stage 22. The ablation solvent 20 is supplied to the crushed/sized ore material 14 to initiate dissolving or dispersing or both of the bitumen within the oil sands material, which contributes to soften the lumps and results in ablation and fragmentation of large lumps.

The ablation solvent 20 can include for instance an aliphatic solvent, such as cyclohexane or cyclopentane or cycloheptane, natural gas condensate, or a paraffinic solvent, e.g., pentane, hexane, heptane, iso-pentane, iso-hexane, iso-heptane, or mixtures thereof. In some implementations, the ablation solvent 20 can include pure solvent or recovered solvent from a solvent recovery unit. The ablation solvent 20 can also be a mixture of solvent and bitumen that is recycled from a downstream stage of the NAE process. The bitumen present in the ablation solvent 20 can take the form of partially deasphalted bitumen when coming from a downstream stage where the bitumen has been in contact with a paraffinic solvent. When the extraction stage 22 includes multiple extraction stages, the recycled stream can be from an early stage of the extraction stages, or from a late stage of the extraction stages, or from any stage in between. The choice of the extraction stage from which is derived the recycled stream when the extraction stage includes multiple extraction stages can depend on the desired composition of the ablation solvent 20, for instance in terms of solvent content or deasphalted oil content. In some implementations, the ablation solvent 20 can also include a recycled stream derived from the solvent diluted bitumen 28 produced during the extraction stage 22.

When the ablation solvent 20 includes a mixture of solvent and bitumen from a downstream extraction stage, the ablation solvent 20 can optionally be subjected to a solid-liquid separation to remove solids therefrom prior to being mixed with the oil sands 10, to avoid reintroducing mineral solids into the process. The presence of partially deasphalted bitumen in the ablation solvent 20 can contribute to improving the solubility of bitumen in the ablation solvent 20 and can also enable adjusting the S/B ratio or the solvent-to-ore ratio to limit or avoid precipitation of asphaltenes in the ablation unit. Fresh solvent can also be used in the ablation stage 16, as a portion of the ablation solvent 20 or as all the ablation solvent 20.

In some implementations, the ratio of ablation solvent-to-ore within the ablation unit can range for instance from about 0.25:1 to about 10:1, from about 0.25:1 to about 5:1, from about 0.25:1 to about 3:1, from about 0.25:1 to about 2:1, from about 0.25:1 to about 1:1, or be less than about 1:1. A higher solvent-to-ore ratio can be beneficial for faster dissolution of bitumen, to provide a heating source which can contribute to faster dissolution ablation or shear ablation or both while reducing shear ablation efficiency by reducing inertial forces, and to facilitate ablation when the lump size of the crushed/sized ore material 14 is larger. A lower solvent-to-ore ratio can be beneficial for reducing overall solvent consumption in the NAE process, for instance when the lump size of the crushed/sized ore material 14 is smaller. It is to be noted that when referring herein to a solvent-to-ore, the solvent-to-ore ratio represents a weight:weight ratio, which can be expressed for instance as kilograms of solvent relative to kilograms of ore.

In some implementations the solvent-to-ore ratio can be chosen so as to produce an ablated ore 18 having certain characteristics. For instance, it may be desirable that the ablated ore 18 be a thick slurry mixture such that the viscosity of the slurry mixture facilitates the disintegration of the ore lumps.

When the ablation solvent 20 includes a paraffinic solvent, the solvent-to-ore ratio or the S/B ratio can be controlled so as to remain within a range that enables avoiding asphaltenes precipitation, i.e., a solvent-to-ore ratio or an S/B ratio that is below an asphaltene precipitation onset, and can thus vary depending on the paraffinic solvent used, ore grade, and the amount of deasphalted bitumen present in the ablation solvent 20.

Ablator Unit Implementation

Various types of equipment and configurations can be used to perform the ablation stage 16, to achieve the contacting of the crushed/size oil sands material 14 with the ablation solvent 20 and the further reduction in size of the lumps of crushed/size oil sands material 14 to produce the ablated ore 18. These will now be described in further detail.

In some implementations, the ablation stage 16 can be performed in a standalone unit that is distinct from the equipment used for the extraction stage 22. Performing the ablation of the crushed/sized oil sands material 14 in one or more standalone units can provide benefits such as being adaptable to the characteristics of the oil sands material supplied thereto, for instance depending on the amount and size of reject material present, the presence of frozen ore, or the quality of the ore. In particular, performing the ablation stage 16 in one or more standalone units provided in series can enable the rejection of material from the ablated ore 18 that could be detrimental to the downstream operation of the extraction stage 22. Different strategies can be implemented to avoid the carry-over of such reject material from the oil sands ore 10 to the extraction stage 22, which in turn can enable the extraction stage 22 to be operated to process an oil sands material that is relatively uniform and conditioned for the extraction stage 22, which in turn can improve the extraction of bitumen from the oil sands ore, and can prevent mechanical damages, plugging, and/or upset conditions in the extraction stage 22. As mentioned above with reference to FIGS. 1B-1C, the separation of reject material can be performed as part of the operation of the ablator, or can be performed as a distinct reject separation stage, i.e., performed in a distinct equipment downstream of the ablator.

In addition, performing the ablation stage 16 in a standalone unit that is distinct from the equipment used for the extraction stage 22 can offer the opportunity to operate each unit according to given operating parameters to enhance the performance of each of the stages.

In other implementations, the ablation stage 16 and the extraction stage 22 can be performed within the same vessel or equipment, such that the ablation of the crushed/sized oil sands material 14 occurs upstream of the extraction but within the same vessel, with various setups that can enable the removal of reject material 60 from the ablated ore 18 such that carry-over to the extraction stage 22 is avoided.

Conveyor Implementations

In some implementations, the ablation stage 16 can be performed in an ablator that includes one or more conveyors that each comprises at least one rotating assembly. Each conveyor can be for instance an auger type conveyor, i.e., a conveyor having a blade or flightings helically mounted around a corresponding shaft, or a rotating conveyor using a shaft having rods, baffles, blades, flights, and/or paddles (or a combination thereof) that are oriented and configured to provide mixing energy to the crushed/sized oil sands material 14 and advance the ablated ore 18 in a downstream direction. These elements on the shafts can be also called projections. When the conveyor 50 includes a shaft having rods, baffles, blades, flights, and/or paddles or a combination thereof, the conveyor 50 can also be referred to as a "log washer".

The conveyor 50 can provide mixing conditions to facilitate contact of the crushed/size oil sands material 14 with the ablation solvent 20, which in turn can facilitate dissolution ablation and shear ablation (also referred to as peeling ablation). The contact force of projections exerted on the lumps can break the lumps to smaller fragments. Also, the contact of the projections with the crushed/size oil sands material 14 induces lump-to-lump contact and lump-to-conveyor trough contact, which also provides attrition energy to induce mechanical ablation that can contribute to accelerating ablation of the crushed/size oil sands material 14.

FIGS. 4A to 5B illustrate implementations of the ablation stage 18 that is performed in a standalone ablator 48 that includes a conveyor 50, such as a log washer type equipment or an auger type equipment. The conveyor 50 can include at least one rotating element 54 mounted in an ablator trough 52 and that rotates about its longitudinal axis. The ablator trough 52 includes a downstream end 56 and an upstream end 58. The ablator trough 52 can be generally horizontal, or can be provided as an inclined ablator trough. When the ablator trough 52 is provided as an inclined ablator trough, the inclination can be toward the downstream end 56 of the ablator trough 52, in which case gravity force can provide additional energy to transport the mixture of crushed/size oil sands material 14 and ablation solvent 20, and eventually ablated ore 18, in a downstream direction. Alternatively, the inclination can be toward the upstream end 58 of the ablator trough 52, in which case the effective residence time of the mixture of crushed/size oil sands material 14 and ablation solvent 20, and eventually ablated ore 18, within the ablator trough 52 can be longer. Longer residence time within the ablator trough can enable reducing the size of the ablator, which can contribute to reducing equipment size and costs. In some implementations, the conveyor 50 is provided at an angle ranging between about 0 degrees and about 45 degrees.

Figure 4A:
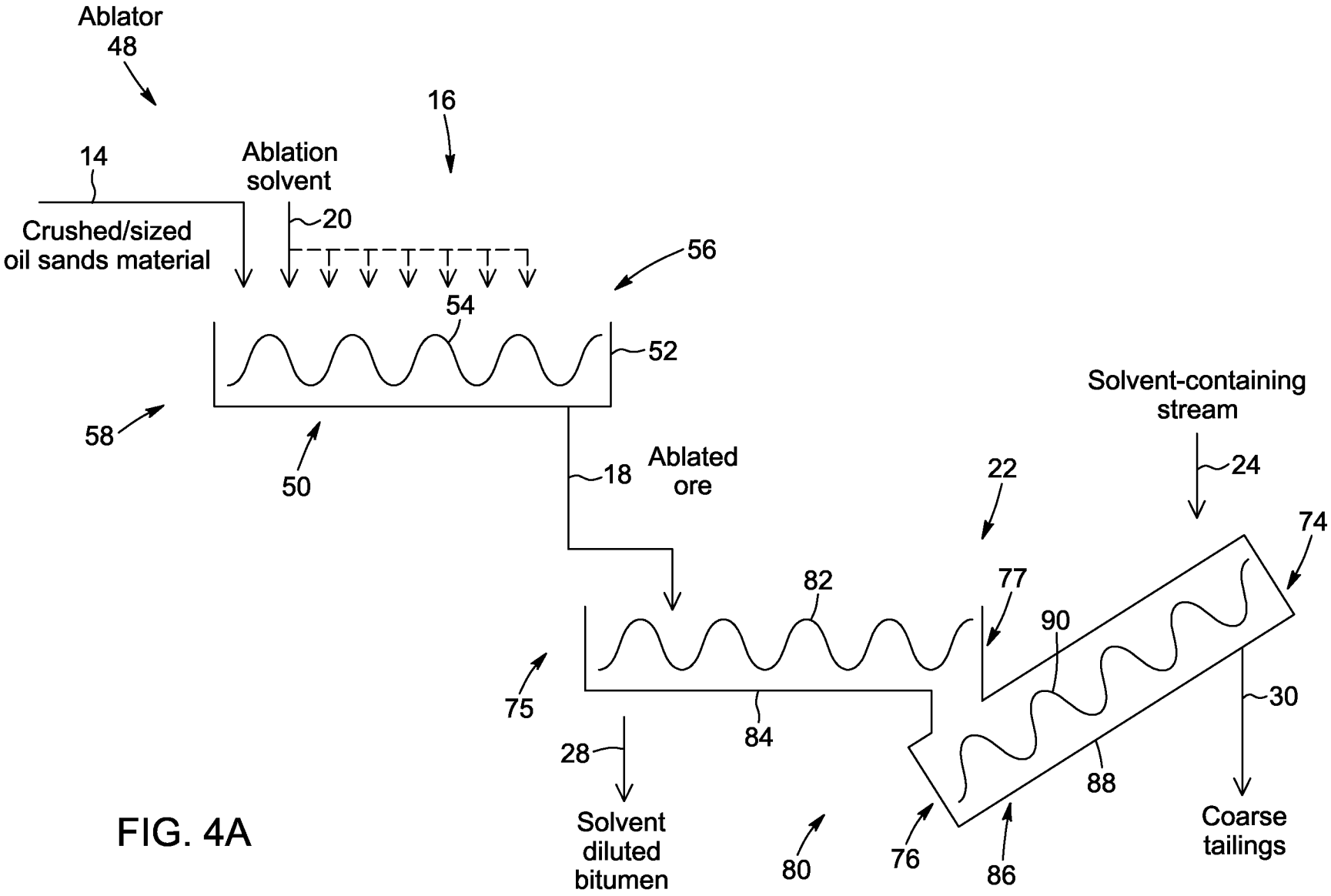
FIG. 4A is a schematic representation of an ablator for performing an ablation stage followed by an extraction assembly, wherein the ablator includes a conveyor that is operated co-currently.
Figure 4B:
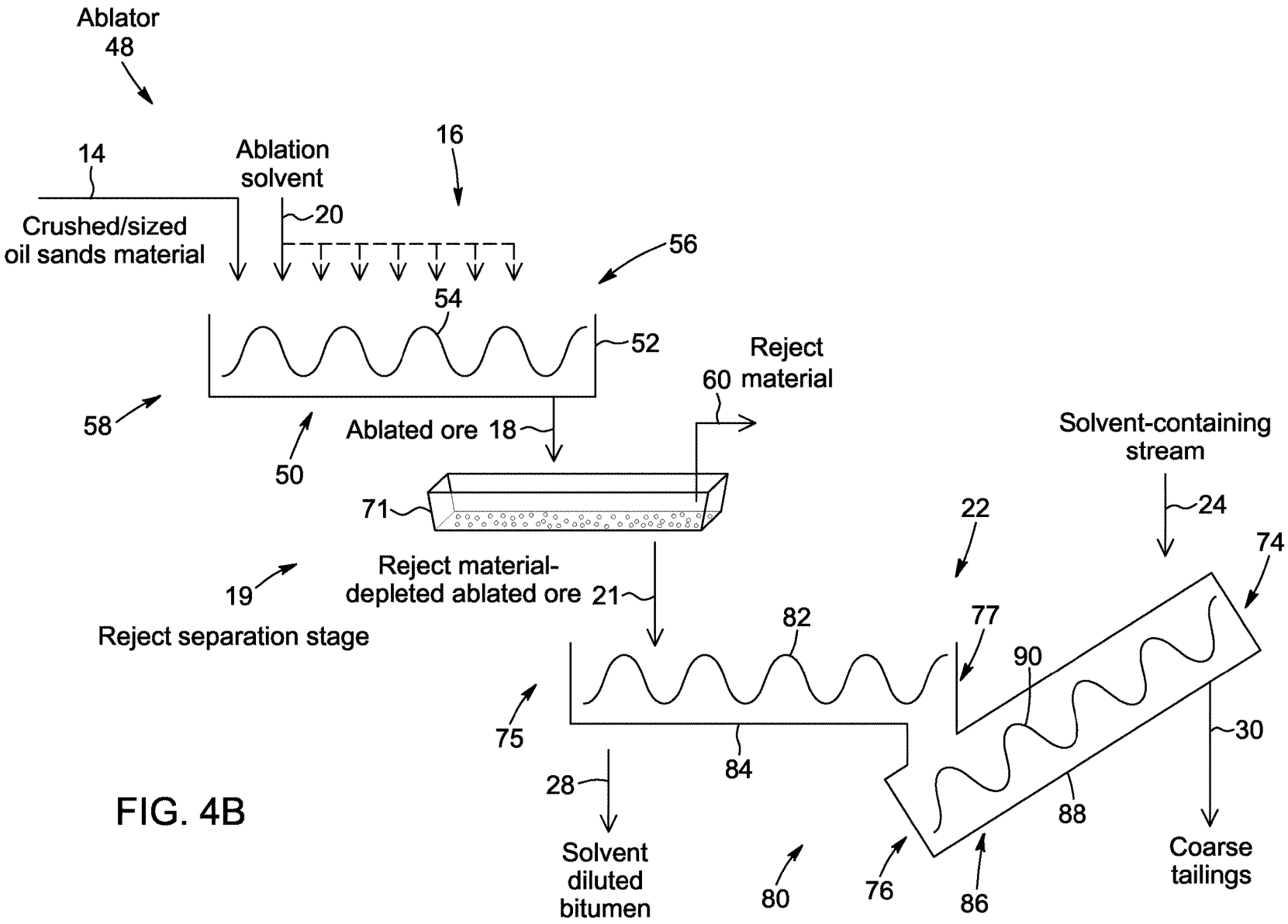
FIG. 4B is a schematic representation of an ablator for performing an ablation stage, a reject separation unit for performing a reject separation stage, the ablation stage and the reject separation stage being followed by an extraction assembly, wherein the ablator includes a conveyor that is operated co-currently.
Figure 5A:
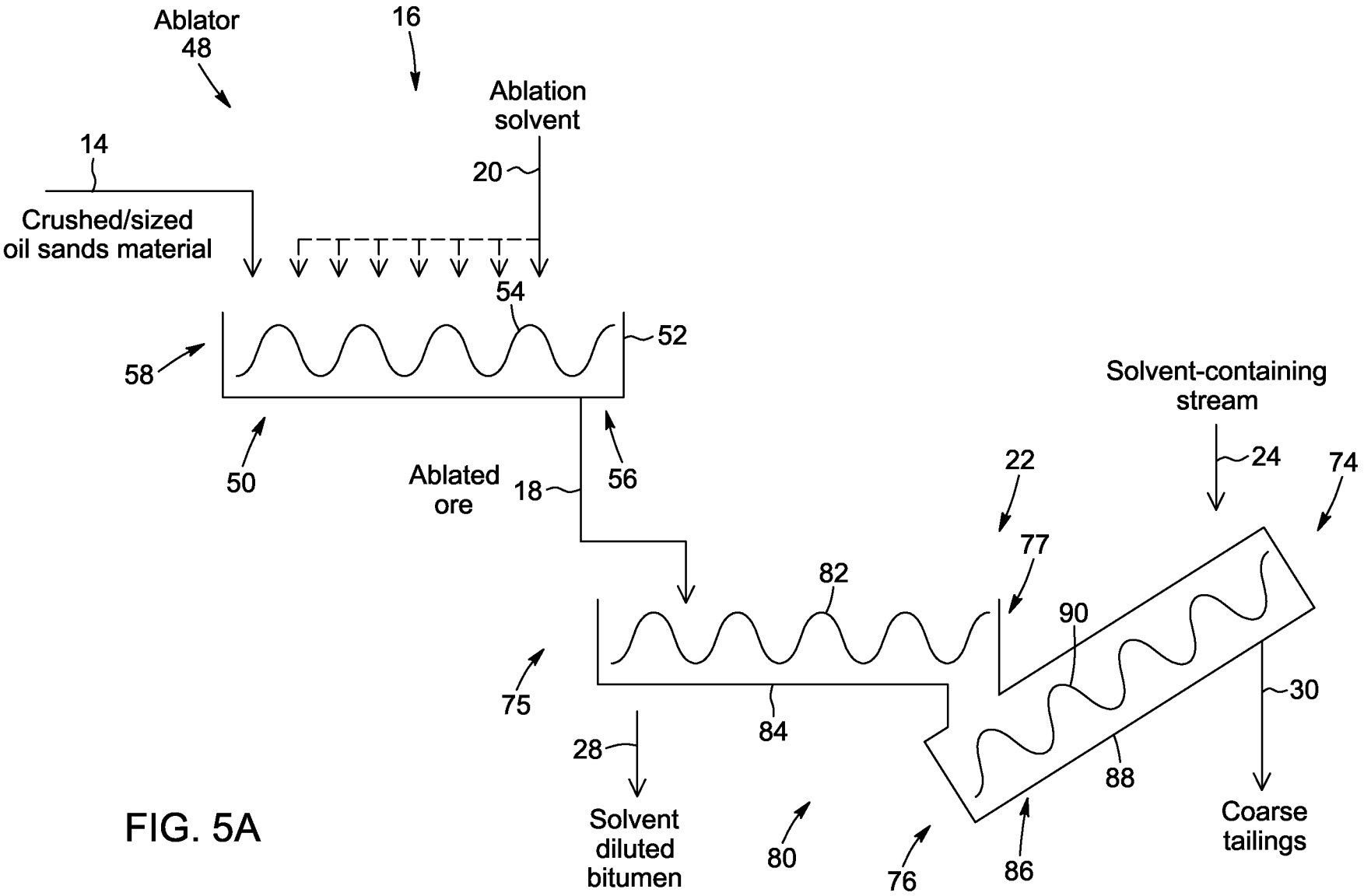
FIG. 5A is a schematic representation of an ablator for performing an ablation stage followed by an extraction assembly, wherein the ablator includes a conveyor that is operated counter-currently.
Figure 5B:
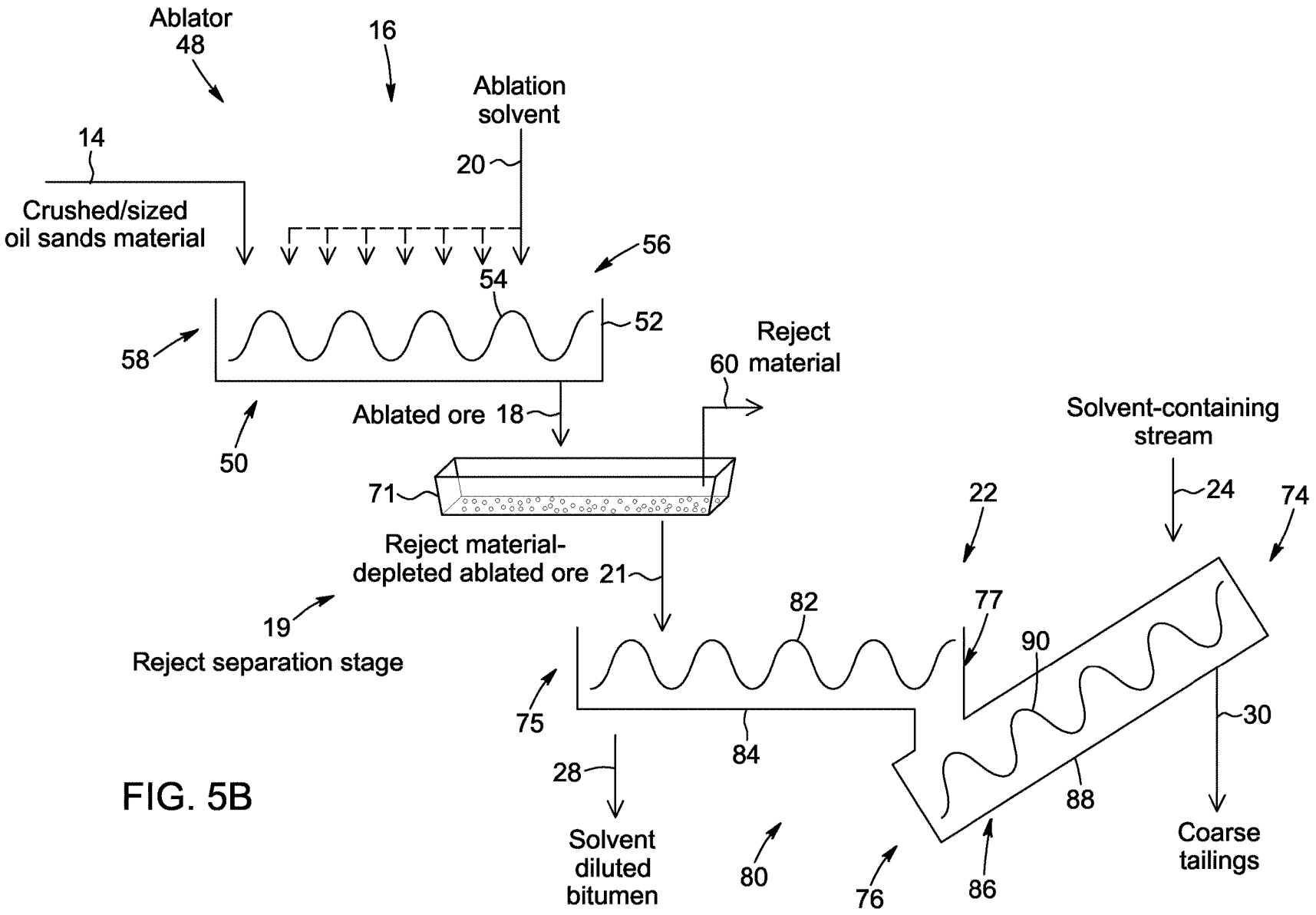
FIG. 5B is a schematic representation of an ablator for performing an ablation stage, a reject separation unit for performing a reject separation stage, the ablation stage and the reject separation stage being followed by an extraction assembly, wherein the ablator includes a conveyor that is operated counter-currently.

FIGS. 4A-4B illustrate an implementation where the conveyor 50 is operated according to a co-current arrangement, while FIGS. 5A-5B illustrate an implementation where the conveyor 50 is operated according to a counter-current arrangement.

Referring to FIGS. 4A-4B, in the co-current arrangement, the crushed/sized oil sands material 14 and a majority or all of the ablation solvent 20 are supplied to the conveyor 50 proximate to the upstream end 58 of the conveyor 50, with the ablated ore 18 being retrieved from the conveyor 50 proximate to the downstream end 56 of the conveyor 50. As illustrated in FIGS. 4A-4B, when the majority of the ablation solvent 20 is supplied proximate to the upstream end 58 of the conveyor 50, additional ablation solvent 20 can be supplied along a section of the conveyor 50 or along the entire length of the conveyor 50. Supplying the ablation solvent 20 along a section of the conveyor 50 or along an entire length of the conveyor 50 can facilitate distributing the ablation solvent 20 more evenly over the crushed/sized oil sands material 14. For instance, additional ablation solvent 20 can be sprayed over the crushed/sized oil sands material 14 over the length of the conveyor 50. When a majority of the ablation solvent 20 is supplied at the upstream end 58 of the conveyor 50 in the co-current configuration, it is meant that more than 50% of the quantity of the ablated solvent 20 is supplied to the upstream end 58 of the conveyor 50.

Referring to FIGS. 5A-5B, in the counter-current arrangement, the crushed/sized oil sands material 14 is supplied to the conveyor 50 proximate to the upstream end 58 of the conveyor 50, with the ablated ore 18 being retrieved from the conveyor 50 proximate to the downstream end 56 of the conveyor 50. In this implementation, a majority or all of the ablation solvent 20 is supplied to the conveyor 50 proximate the downstream end 56 of the conveyor 50. When the majority of the ablation solvent 20 is supplied proximate to the downstream end 56 of the conveyor 50, additional ablation solvent 20 can also be supplied along a section of the conveyor 50 or along the entire length of the conveyor 50. As mentioned above, supplying the ablation solvent 20 along a section of the conveyor 50 or along the entire length of the conveyor 50, for instance by spraying, can facilitate distributing the ablation solvent 20 more evenly over the crushed/sized oil sands material 14. Again, when a majority of the ablation solvent 20 is supplied at the downstream end 56 of the conveyor 50 in the counter-current configuration, it is meant that more than 50% of the quantity of the ablated solvent 20 is supplied to the downstream end 56 of the conveyor 50.

In some implementations, the ablated solvent 20 can be distributed over the crushed/sized oil sands material 14 along the length of the conveyor 50 without a majority of the ablation solvent 20 being distributed at the upstream end 58 or the downstream end 56 of the conveyor 50. In such implementations, the ablation solvent 20 can thus be distributed substantially evenly over the entire length of the conveyor 50. In other words, the ablation solvent 20 can be supplied to the conveyor 50 at any location along the ablator trough 52, for instance by providing the ablation solvent 20 over the surface area of the crushed/sized oil sands material 14, e.g., by spraying or other similar techniques. Distributing the ablation solvent 20 over the surface area of the crushed/sized oil sands material 14 can be performed to enhance the contact of a large surface of crushed/sized oil sands material 14 with the ablation solvent 20.

The rotating element 54 of the conveyor 50 includes a longitudinal shaft and projections extending outwardly from the longitudinal shaft to provide high mixing energy while advancing the ablated ore along the length of the ablator trough. The projections of the rotating element 54 can be of various types, including baffles, paddles, blades, rods, flights, augers, and/or other types of projections that are discrete or continuous. The shaft of each rotating element 54 can also have various designs, having a small or large diameter, being configured for connection of certain projections thereto, being constructed to enable mounting within the ablator trough 52 in a certain manner and to connect with motors, and so on. The operation of the rotating element 54 facilitates the contact of the ablation solvent 20 with the crushed/sized oil sands material 14, which in turn facilitates the disintegration and digestion of the crushed/sized oil sands material 14. As mentioned above, the contact force of projections exerted on the lumps can break the lumps to smaller fragments, and the contact of the projections with the crushed/size oil sands material 14 also induces lump-to-lump contact and lump-to-conveyor trough contact, which provides attrition energy to induce mechanical ablation that can contribute to accelerate ablation of the crushed/size oil sands material 14.

In the implementations of the conveyor 50 illustrated in FIGS. 4A-5B, the conveyor 50 is configured for transporting the mixture of crushed/size oil sands material 14 and ablation solvent 20, and eventually ablated ore 18, is a downstream configuration. The projections of the rotating element 54 can thus be designed to impart mixing energy to the crushed/sized oil sands material 14 while also conveying or advancing the ablated ore 18 downstream along the ablator trough 52. The projections can therefore be angled or shaped to impart some force in the downstream direction or upstream direction, and be configured to provide a desired combination of mixing and advancing.

The rotating element 54 can be a single shaft configuration, a dual shaft configuration arranged side-by-side, or other configurations of multiple shaft rotating elements arranged within a correspondingly constructed ablator trough 52.

The rotating elements 54 can have various features that can be designed and implemented depending on certain functions that may be desired in different parts of the conveyor 50. For instance, the rotating elements 54 can have various combinations of discrete and continuous projections extending from the shafts. The rotating elements 54 can also be divided into shaft segments having different lengths and/or arrangements. Each shaft segment can have a different arrangement of projections, in terms of their type, structure, spacing, length, orientation, angle, width, distribution, and so on. There may be up to "n" segments that make up the rotating element. Each segment can be designed to provide or promote desired functions. For instance, a segment can be designed to promote transportation of the solids with lower mixing energy (e.g., using an auger type structure), while another segment can be designed to promote disintegration and digestion (e.g., using paddles that are designed to provide high mixing energy to the solids). Each segment along the shafts of the rotating element can therefore be tailored in various ways to provide desired effects. The segments can be of the same or different length. When two side-by-side rotating elements 54 are used, they can be substantially the same in terms of their segments or they can be different. Alternatively, the rotating elements 54 can also be provided so that the projections are the same along the entire length of the shaft and are provided in a single consistent arrangement.

In some implementations, the rotating elements 54 can be configured in parallel relative to each other and can be operated to rotate in opposite directions with respect to one another during regular operation such that they produce an upward movement in the center of the ablator trough 52 and thus a downward movement at the outer edges of the ablator trough 52. The shafts of the rotating elements 54 can also be configured to rotate at substantially the same speed (e.g., between about 50 and 210 rpms) to promote central conveyance, although it is appreciated that other configurations and operating parameters are possible. For example, the rotating elements 54 can be made to rotate in the same direction, or in opposite directions but producing a downward movement in the center of the ablator trough 52. It should also be noted that the direction of rotation of the rotating elements 54 can be reversed during operation, for example, if material, such as a rock, becomes stuck between the projections of a given rotating element. Moreover, the projections of the rotating element can be shaped and sized so as to interlock, or overlap each other in a central region of the ablator trough. When the conveyor 50 is operated in a counter-current configuration, such as shown in FIGS. 5*a*-5B, the projections can be spaced from each other in the central region to promote counter-current displacement of liquids and solids within the ablator trough 52.

The shaft from which extend the rotating element 54 is operatively connected to a motor. When more than one rotating element 54 is provided, corresponding motors can be provided to rotate the shafts independently from each other in a joint or coordinated manner. The motors can be fixed together on a common frame or independently. Various motor constructions and implementations are possible. The motors can be controllable to provide variable rotation speeds and/or torques depending on certain variables of the process.

The crushed/sized oil sands material 14 can be fed to the conveyor 50 from above and proximate to the upstream end 58 via a feedwell that is fed ore from a sized ore hopper. Other locations for feeding the crushed/sized oil sands material 14 into the conveyor 50 are possible. An ore inlet is therefore provided and is in fluid communication with the feedwell. The ore inlet can be provided as an opening in the top of the conveyor 50.

In some implementations, in contrast with the operation of a conveyor for an extraction stage, the solvent-to-ore ratio within the ablation stage 16 may not result in a layer of solvent diluted bitumen on top of a solids bed with the solids moving downstream and the solvent diluted bitumen moving upstream. In other implementations, a layer of solvent diluted bitumen may be obtained on top of a solids bed with the solids moving downstream and the solvent diluted bitumen moving upstream. The liquid level, i.e., the level of solvent diluted bitumen 28 and/or of ablation solvent 20, in the ablator trough 52, can be controlled by the presence of a weir or a similar outlet mechanism.

The sizing of the ablator trough 52 and the feed rates at which the crushed/sized oil sands material 14 and the ablation solvent 20 are fed to the conveyor 50 can be such that the reduction in the size of the lumps is achieved and the ablated ore 18 has desirable characteristics for being supplied to the subsequent extraction stage 22. The rotating elements operate to promote mixing of the solid and liquid phases together such that substantially the content of the ablator trough 52 becomes a heterogenous slurry, which may not be fluidized.

In some implementations, the conveyor 50 can be configured as a covered and sealed conveyor to contain vapours from the ablation solvent and reduce the release of ablation solvent 20 to the surroundings. In addition, providing the conveyor 50 as a sealed conveyor can also prevent air ingress to maintain low levels of oxygen in the head-space which, as mentioned above, can prevent flammable conditions within the ablation stage 16. An inert gas, such as nitrogen, carbon dioxide, or natural gas can be supplied to the sealed conveyor to displace oxygen and prevent air ingress.

In some implementations, the conveyor 50 can be operated at a pressure ranging between about 80 psig to about 120 psig, or between about 90 psig to about 110 psig, in which case the conveyor can be referred to as a pressurized conveyor. Alternatively, the conveyor 50 can be operated at a pressure slightly above atmospheric pressure, such as about 1 psig to about 15 psig above atmospheric pressure, to control air ingress. Operating the conveyor 50 at a given pressure can be facilitated by the conveyor being provided as a sealed conveyor.

In some implementations, the conveyor 50 can be equipped with a heating system to provide heat to the crushed/sized oil sands material 14 that can be frozen, to accelerate ablation of the frozen ore lumps, for instance during colder months of the year. Frozen ore lumps can have a temperature ranging from about −20° C. to about −5° C., and therefore it may be advantageous to provide heat to such lumps to reduce ablation time. Providing heat to the crushed/sized oil sands material 14 or the ablation solvent 20 or both can also contribute to accelerating ablation during warmer months of the year, even when no frozen ore lumps are present, for instance when the ore lumps have a temperature ranging between about 0° C. to about 10° C. The heating system to provide heat to the conveyor 50 can include a steam jacket, a direct heating system, and/or an indirect fired heating system. The indirect heating system can use a fuel such as natural gas. Alternative heating arrangements are also possible and other fuels can be used, including fuels derived directly from the extraction process.

When the ablated ore 18 is produced in a distinct piece of equipment than the equipment used for the extraction stage 22, the ablated ore 18 can be supplied to the extraction stage 22 as a slurry of grain-sized material using a gravity-fed system or any other suitable means for transporting a slurry, such as slurry pump or a screw conveyor.

A notable distinction between a conveyor configured to perform an ablation stage 16 and a conveyor configured to perform an extraction stage 22 is that the conveyor configured to perform an ablation stage 16 can include a single outlet to withdraw a given material, which is the ablated ore 18. In contrast, a conveyor configured to perform an extraction stage 22 can generally include at least two outlets: a first one for withdrawing solvent diluted bitumen 28, and a second one for withdrawing coarse tailings 30, which are two distinct streams that are produced during the extraction stage 22. Of course, various configurations can also be implemented to withdraw more than one stream of ablated ore 18 from the ablator 48.

Referring more specifically to FIGS. 4A and 5A, in some implementations, the conveyor 50 can be configured to enable separation of reject material (not shown) or non-ablating material, such as rocks, gravels, coal, petrified wood, or tree roots, or any other non-ablating oversized reject, from the ablated ore 18 that is subsequently supplied to the extraction stage 12. For instance, the conveyor 50 can include a screen or a sieve through which a given size of ablated ore 18 can pass through while oversized rejects are retained within the ablator trough 52. The screen can include openings having a size in the range of about 0.5 inch to about 2 inches to remove rejects that are larger than the openings size, and allow the grain-sized material or partially ablated lumps having a lump size smaller than the size of the openings to pass through the screen and be supplied to the extraction stage 22. A screen having larger openings than 2 inches can also be suitable, such as openings having a diameter of about 4 inches, about 6 inches, or about 8 inches. The reject material, which can have residual solvent on its surface, can then be transported, for instance by gravity or by a conveyer, to a solvent recovery unit, such as a solvent stripping unit, to remove the residual solvent therefrom. Given that most of the reject material 60 can be non-porous material, such as rocks and gravels, the amount of solvent adsorbed can be relatively small and be present mostly on the surface, and can represent for instance less than about 5 wt % of the reject material, or less than about 1 wt % of the reject material.

Alternatively, the conveyor 50 can be operated such that reject material remains present in the ablated ore 18, i.e., such that the reject material is not separated from the ablated ore 18, the reject material being carried over to the extraction stage 22.

Still referring to FIGS. 4A and 5A, the conveyor 50 is in fluid communication with equipment for performing the extraction stage 22, which is illustrated to include an extraction assembly 80. The extraction assembly 80 includes a rotating element 82 mounted in an extractor trough 84 and that rotates about its longitudinal axis, the rotating element 82 including a longitudinal shaft and elements extending outwardly from the longitudinal shaft. The extractor trough 84 includes an extractor upstream end 75 and an extractor downstream end 77. The extractor assembly 80 also includes an inclined classifier assembly 86 that includes a classifier trough 88 and a helically configured rotating element 90 mounted in the classifier trough 88, the classifier assembly 86 including a classifier downstream end 74 and a classifier upstream end 76. The extractor downstream end 77 of the extractor trough 84 is in fluid communication with the classifier upstream end of 76 of the classifier trough 88. The ablated ore 18 is supplied to the extraction assembly 80 to be subjected to the extraction stage 22.

Referring more specifically now to FIGS. 4B and 5B, an alternative implementation to manage reject material when the ablator includes a conveyor 50 is shown. In this implementation, a reject separation stage 19 is placed downstream of the ablation stage 16 and upstream of the extraction stage 22, i.e., between the conveyor 50 and the extraction assembly 80, when the ablation stage 16 and the extraction stage 22 are performed in distinct pieces of equipment. The reject separation stage 19 can be performed using a reject separation unit 71 such as a gravity settler or screen, which can be for instance a vibrating screen or a grizzly screen, although other pieces of equipment are also suitable. The reject separation stage 19 produces a stream of reject material 60 and a stream of reject material-depleted ablated ore 21. The reject material-depleted ablated ore 21 can then be supplied to the extraction stage 22, e.g., to the extractor upstream end 75 of the extractor assembly 80. The reject separation unit 71 can be sealed to prevent air ingress and maintain low levels of oxygen to prevent flammable conditions. Wash solvent can be also sprayed over the reject material in the reject separation stage 19 to recover solvent diluted bitumen and increase overall bitumen recovery.

Figure 6:
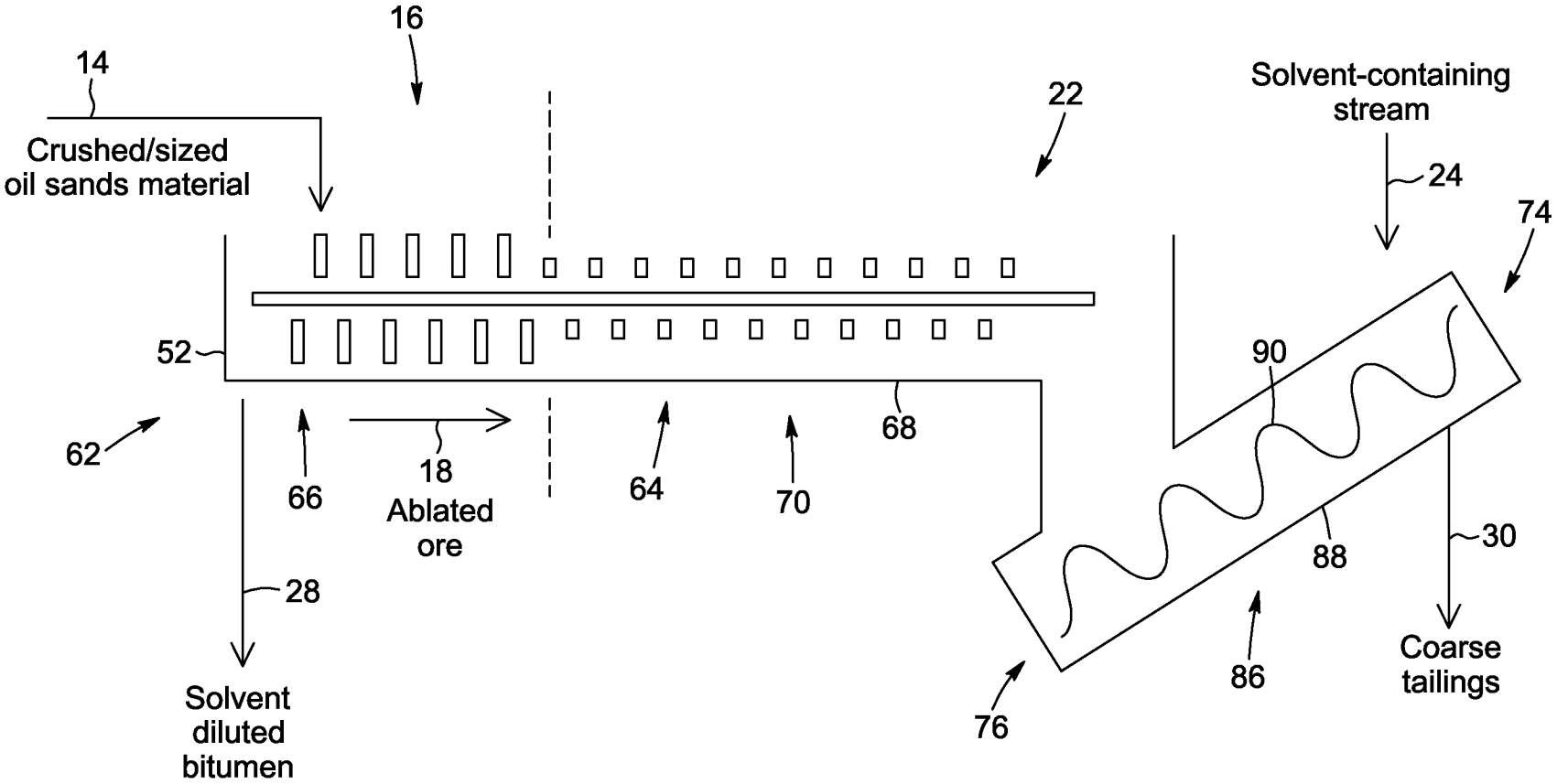
FIG. 6 is a schematic representation of a conveyor used for performing an ablation stage and an extraction stage, the conveyor being in fluid communication with a classifier assembly as another portion of the extraction stage.

With reference now to FIG. 6, an implementation where the ablation stage 16 and the extraction stage 22 are performed in a common, or single, piece of equipment is shown. The single piece of equipment can be a conveyor that is configured to include an ablation zone 62 in an upstream portion 66 of a conveyor trough 68, and an extraction zone 64 in a downstream portion 70 of the conveyor trough 68. Rotating elements that are the same or different throughout the shaft can be provided in each of the ablation zone 62 and the extraction zone 64. When the rotating elements are different in the ablation zone 62 compared to the rotating elements in the extraction zone 64, the rotating elements can be chosen to achieve given objectives in the ablation zone 62 and in the extraction zone 64. For instance, in the ablation zone 62, a main objective is to reduce the size of the crushed/sized oil sands material 14 to smaller ore lumps, and to initiate contact with a solvent, i.e., the ablation solvent 20, to favour the disintegration of the ore lumps. Part of these objectives can also be fulfilled in the extraction zone 64, in addition to the digestion, extraction and separation of the bitumen from the ablated ore 18. The operating conditions of the conveyor can also be different for the rotating element in the ablation zone 62 compared to the rotating elements in the extraction zone 64. For instance, at least two rotating elements can be provided, which can be referred to an ablation rotating element and an extraction rotating element, each being mounted on a respective shaft. The ablation rotating element can include projections extending within the ablation zone 62, while the extraction rotating element can include projections extending in the extraction zone 64. In such a configuration, the rotating elements can be independently operated, for instance in terms of rotation speeds, to achieve desired performances in the ablation zone 62 and in the extraction zone 64. Whether the rotating elements are provided as distinct rotating elements or if a single rotating element, the configuration of the projections can vary depending on their location along the length of the conveyor trough 68, i.e., depending on if the projections extend in the ablation zone 62 or in the extraction zone 64. For instance, in the ablation zone 62, the projections can be shorter and with round edges, and in the extraction zone 64, the projections can be longer and have sharp edges, or vice versa. Additional aspects of the projections that can be modified whether they are provided in the ablation zone 62 or the extraction zone 64 include the spacing between the projections, and the angle at which the projections extend from the shaft, for example. In some implementations, the projections extending in the ablation zone 66 can be configured as being sturdier, thicker and with a larger space in between to accommodate the lumps of the crushed/sized oil sands material 14, compared to the projections extending in the extraction zone 64. The spacing of the projections can also be adapted to accommodate a certain size of lumps. For instance, for larger lumps of oil sands material provided to the ablation zone 62, the spacing between projections extending in the ablation zone 62 can be larger, while for smaller lumps of oil sands material provided to the ablation zone 62, the spacing between projections extending in the ablation zone 62 can be smaller. This also applies to the clearance between the projections and trough surface.

Still referring to FIG. 6, the crushed/sized oil sands material 14 can be supplied proximate to the upstream portion 66 of the conveyor trough 68, in the ablation zone 62. In the implementation shown in FIG. 6, the ablation solvent 20 can be the solvent diluted bitumen that is travelling in an upstream direction toward the upstream portion 66 of the conveyor trough 68, the solvent diluted bitumen eventually contacting the crushed/sized oil sands material 14 in the ablation zone 66. Although not shown in FIG. 6, additional ablation solvent can also be supplied the conveyor trough 68. Similarly to the concepts described above, when an additional ablation solvent is supplied to the conveyor trough 68, a majority or all of the additional ablation solvent can be supplied to the conveyor trough 68 proximate to the upstream portion 66 of the conveyor trough 68 or the downstream portion 70 of the conveyor trough 68. When the majority of the additional ablation solvent is supplied proximate to the upstream portion 66 or the downstream portion 68 of the conveyor trough 68, a portion of the additional ablation solvent can be supplied along a section of the conveyor trough 68 or along the entire length of the conveyor trough 68. Supplying additional ablation solvent along a section of the conveyor trough 68 or along an entire length of the conveyor trough 68 can facilitate distributing the additional ablation solvent more evenly over the conveyor trough 68. For instance, the additional ablation solvent can be sprayed over the conveyor trough 68. It is to be understood that the additional ablation solvent, whether supplied as a single source or multiple sources, can thus be supplied at any location along the length of the conveyor trough 68.

Still referring to FIG. 6, the ablated ore 18 travels downstream along the length of the conveyor trough 68 to subsequently be subjected to extraction in the extraction zone 64. The solvent-containing stream 24 can be supplied proximate to a downstream end 74 of the classifier auger 88. Thus, the combination of the ablation zone 66 and the extraction zone 64 of the conveyor trough 68 and the classifier trough 88 can be operated counter-currently. In the counter-current configuration, the ablated ore 18 travels in a downstream direction from the ablation zone 66 towards the extraction zone 68, and solids also travel in a downstream direction towards the downstream end 74 of the classifier trough 88 to be retrieved as a coarse tailings 30 stream and supplied for instance to a coarse solids pump box, and the solvent diluted bitumen travels in an upstream direction toward the ablation zone 62 to be retrieved and supplied for instance to a surge tank. The solvent diluted bitumen 28 can be retrieved for instance proximate to the upstream end 62 of the conveyor 50.

In some implementations, the transition from the ablation zone 62 to the extraction zone 64 along the length of the conveyor trough 68 can occur in a transition zone located at a certain distance from the upstream end of the conveyor trough 68, such that the ablation zone 62 has a length that can be expressed as a percentage of the total length of the conveyor trough 68. In FIG. 6, the location of the transition zone is schematically illustrated as a dotted line. In some implementations, the transition from the ablation zone 62 to the extraction zone 64 can be defined as the location where the ablated ore 18 reaches a certain size. For instance, if the crushed/sized oil sands material 14 supplied to the ablation zone 62 of the conveyor trough 68 is less than about 16 inches, less than about 10 inches, less than about 8 inches, less than about 6 inches, or less than 4 inches, then the transition zone can be located along the length of the conveyor trough 68 when the ablated ore fragments reach a diameter that is less than about 2 inches, less than about 1 inch, less than about 0.75 inch, or less than about 0.5 inch.

The location of the transition zone can vary depending on the size of the crushed/sized oil sands material 14 supplied to the ablation zone 62 and the configuration of the ablation zone 62. For instance, larger lumps of crushed/sized oil sands material 14 supplied to the ablation zone 62 may take a longer travelling length along the conveyor trough 68 to reach a certain size, while smaller lumps of crushed/sized oil sands material 14 supplied to the ablation zone 62 may take a shorter travelling length along the conveyor trough 68 to reach that same certain size. As an example, for an oil sands material that includes lumps having a diameter that is less than about 8 inches, the ablation zone 62 can produce ablated ore 18 having a diameter that is less than about 1 inch, and the ablation zone 62 can represent a given percentage of the total length of the conveyor trough 68 to achieve this reduction in size. When an oil sands material that includes lumps having a diameter that is less than about 10 inches, i.e., that includes larger lumps than in the previous example, and for other operating parameters kept the same, the percentage of the total length of the conveyor trough 68 to achieve the same reduction in size, i.e., less than about 1 inch, will be higher. Other factors that can influence the length of the ablation zone 62 include the temperature of the ore, the solvent-to-ore ratio, mixing conditions, and the configuration of the projections in the ablation zone 62. In some implementations, the ablation zone 62 can represent between about 10% to about 60%, or about 20% to about 60%, of the total length of the conveyor trough 68. For a smaller lump size of the crushed/sized oil sands material 14 supplied to the ablation zone 62, this range can shift toward a lower interval of about 10% to about 40%, or about 20% to about 30%, while for a larger lump size of the crushed/sized oil sands material 14 supplied to the ablation zone 62, this range can shift toward a higher interval of about 40% to about 60%, or about 50% to about 60%. It is to be noted that these ranges are given as an example only, and that other intervals are also possible.

Another option to characterize the length of the ablation zone 62 relative to the total length of the conveyor trough 68, i.e., the location of the transition from the ablation zone 62 to the extraction zone 64, is according to a given ablation ratio achieved. The ablation ratio represents the ratio of ablated ore mass relative to the initial ore mass, in percentage. In some implementations, complete ablation can be considered to have occurred when the ablation ratio is more than about 90%, between about 90% and about 95%, or between about 90% and about 98%. In some implementations, partial ablation can be considered to have occurred when the ablation ratio is between about 50% and about 90%. Thus, in some implementations, the ablation zone 62 can represent a certain percentage of the total length of the conveyor trough 68 to achieve complete ablation or partial ablation. For instance, when the ablation zone 62 is configured to achieve complete ablation, the ablation zone 62 can represent between about 30% to about 60%, or about 50% to about 60%, of the total length of the conveyor trough 68, and when the ablation zone 62 is configured to achieve partial ablation, the ablation zone 62 can represent between about 10% to about 40%, or about 20% to about 30%, of the total length of the conveyor trough 68. Of course, these ranges are also given as an example only, and that other intervals are also possible.

It is to be noted that any section of the conveyor trough 68 can include a screen or another device to enable separation of reject material from the ablated ore 18 or from the solids travelling in a downstream direction. For instance, a screen can be placed inside the ablation zone 62, as described above. Alternatively, a screen can be placed in proximity of the transition from the extractor downstream end 77 of the extractor trough 84 to the classifier upstream end 76 of the classifier trough 88. Alternatively, a collection trap box can be placed at the classifier upstream end 76 with reject materials being removed periodically through a controlled gate.

Figure 7A:
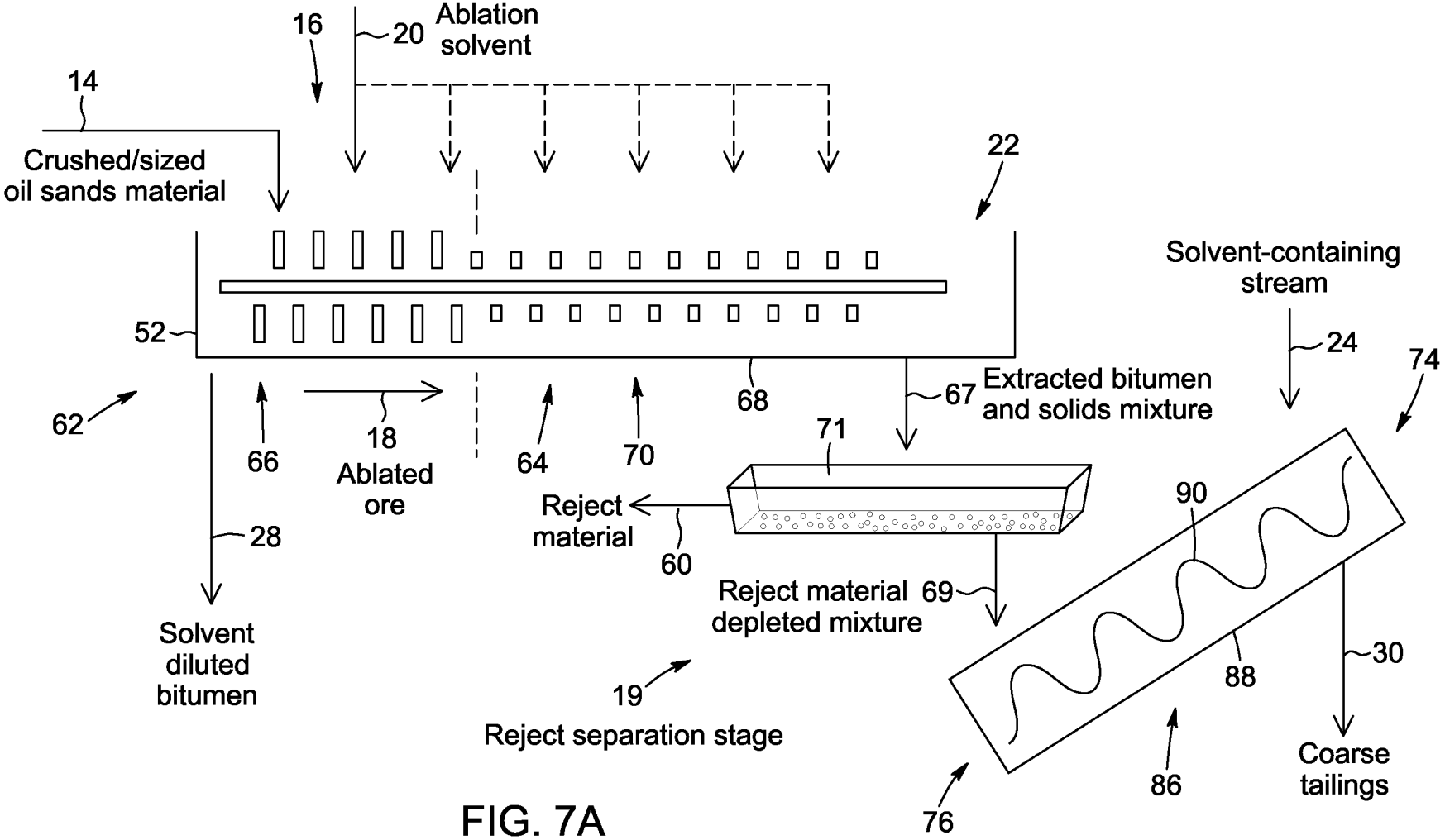
FIGS. 7A-7B are schematic representations of a conveyor used for performing an ablation stage and an extraction stage, a downstream end of the conveyor being followed by a reject separation unit.
Figure 7B:
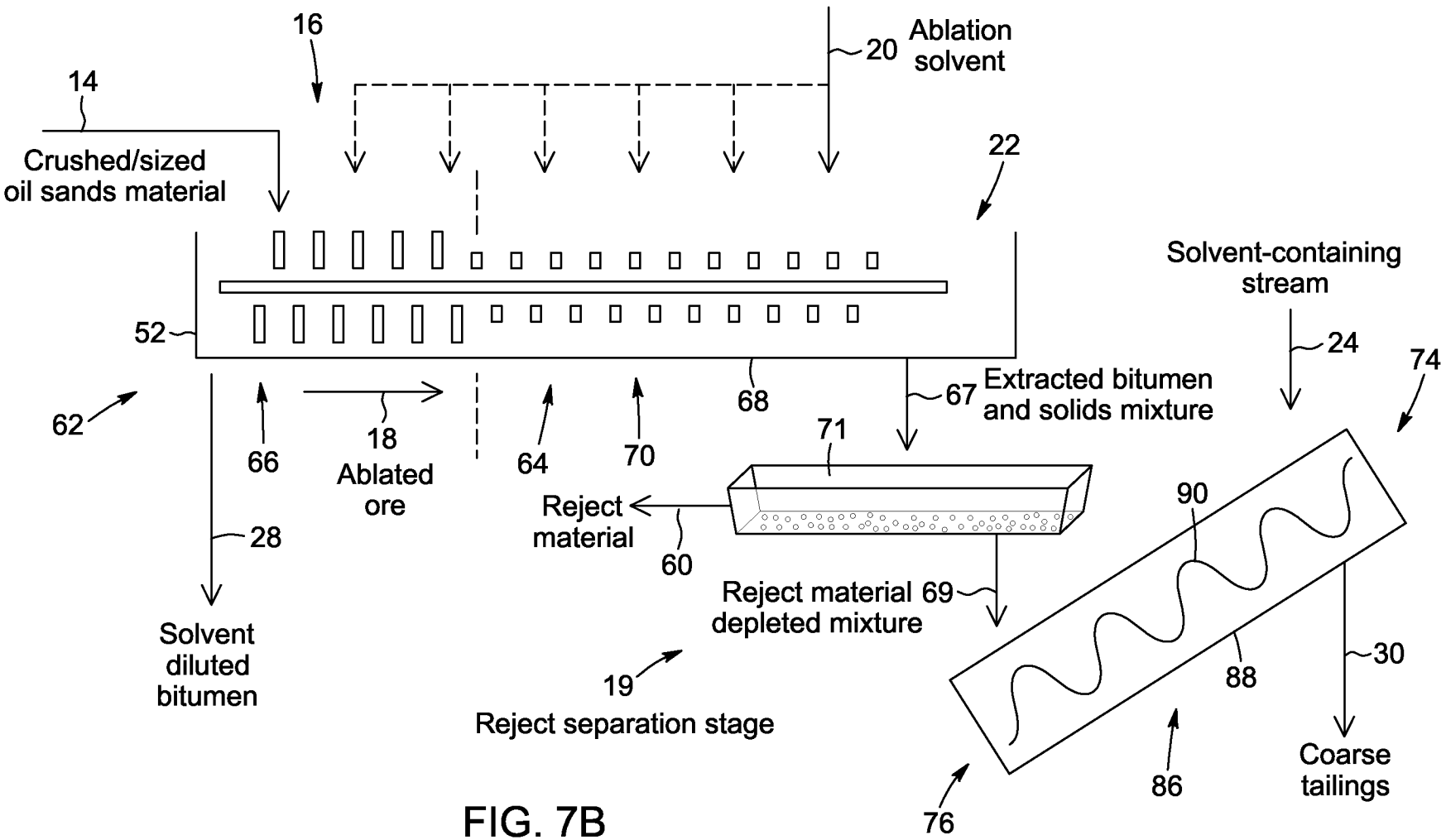

Referring now to FIGS. 7A-7B, another implementation where the ablation stage 16 and the extraction stage 22 are performed in a common, or single, piece of equipment is shown. More particularly, in this implementation, the ablation stage 16 and a portion of the extraction stage 22 are performed in a single conveyor trough 68, and another portion of the extraction stage 22 is performed in a classifier assembly 86 that includes an inclined classifier trough 88. The reject separation stage 19 is performed downstream of the conveyor trough 68 and upstream of the classifier trough 88. The stream withdrawn from the conveyor trough 68 can include solids, solvent diluted bitumen, and reject material, and can be referred to as an extracted bitumen and solids mixture 67. The reject separation stage 19 can be performed for instance using a reject separation unit 71 such as a gravity settler or screen, which can be for instance a vibrating screen or a grizzly screen, although other pieces of equipment are also suitable. The reject separation stage 19 produces reject material 60 and a reject material depleted mixture 69. The reject material depleted mixture 69 can then be supplied to the second portion of extraction stage 22, e.g., to the classifier upstream end 76 of the extractor assembly 80. The screen 71, or another piece of equipment used to perform the reject separation stage 19, can be sealed to prevent air ingress and maintain low levels of oxygen to prevent flammable conditions. This configuration can enable performing the ablation stage 16 and a portion of the extraction stage 22 in a single piece of equipment, while enabling management of the reject material to avoid carry-over of the reject material further downstream. Wash solvent can be also sprayed over the reject material in the reject separation stage 19 to recover solvent diluted bitumen and increase overall bitumen recovery.

FIGS. 7A-7B also illustrate implementations where additional ablation solvent 20, i.e., ablation solvent 20 that is added in addition to the solvent-containing stream 24 supplied is supplied to the conveyor trough 68. A majority or all of the additional ablation solvent can be supplied to the conveyor trough 68 proximate to the upstream portion 66 of the conveyor trough 68 or proximate the downstream portion 70 of the conveyor trough 68. When the majority of the additional ablation solvent is supplied proximate to the upstream portion 66 or the downstream portion 68 of the conveyor trough 68, a portion of the additional ablation solvent can be supplied along a section of the conveyor trough 68 or along the entire length of the conveyor trough 68. Supplying additional ablation solvent along a section of the conveyor trough 68 or along an entire length of the conveyor trough 68 can facilitate distributing the additional ablation solvent more evenly over the conveyor trough 68. For instance, the additional ablation solvent can be sprayed over the conveyor trough 68. It is to be understood that the additional ablation solvent, whether supplied as at a single location or at multiple locations, can thus be supplied at any location along the length of the conveyor trough 68.

Rotary Screen Ablator Implementations

Figure 8:
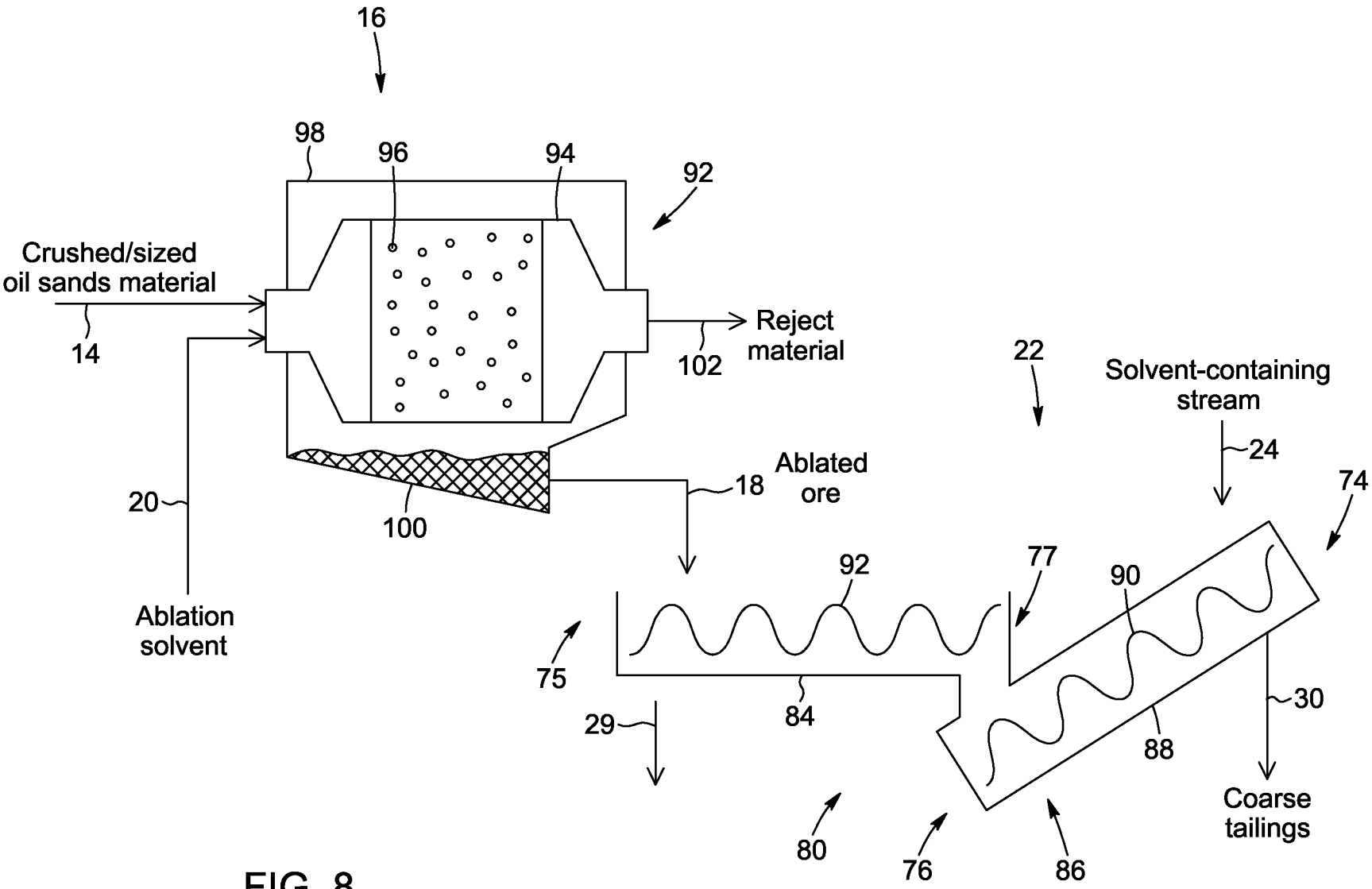
FIG. 8 is a schematic representation of a rotary screen ablator used for performing an ablation stage, the rotary screen ablator being in fluid communication with an extraction assembly.

With reference now to FIG. 8, in some implementations, the ablation stage 16 can be performed in a rotary screen ablator 92. The rotary screen ablator 92 includes a rotating drum 94 with screen openings 96, and may also have breaker, lifter and advancer elements extending from the drum wall internally.

The screen openings 96 of the rotary drum 94 can have a size in the range of about 0.5 inch to about 4 inches, or from about 0.75 inch to about 2 inches, to remove large rejects that are larger than the openings size, and allow the grain-sized material or partially ablated lumps having a lump size smaller than the size of the openings to pass through the screen and be supplied to the extraction stage 22. Openings that are larger than 2 inches can also be suitable, such as openings having a diameter of about 4 inches, about 6 inches, or about 8 inches. When larger openings are provided, partial ablation can occur, in contrast to complete ablation.

The rotary screen ablator 92 can be placed within a closed and sealed horizontally extending cylindrical shell 98 to contain vapours from the ablation solvent and reduce the release of ablation solvent 20 to the surroundings. In addition, a sealed rotary screen ablator 92 can also prevent air ingress to maintain low levels of oxygen in the head-space which, as mentioned above, can prevent flammable conditions within the ablation stage 16. An inert gas, such as nitrogen, carbon dioxide, or natural gas can be supplied to the sealed rotary screen ablator 92 to displace oxygen and prevent air ingress.

The rotating drum 94 can be operated to rotate at a certain rotational speed, which can be in the range of about 1 rpm to about 50 rpm. The rotational speed of the rotating drum 94 can depend on its diameter to maintain a certain liner velocity at the periphery of the rotating drum 94. It is to be understood that as the rotating drum 94 rotates, the horizontally extending cylindrical shell 98 remains stationary. The rotating drum 94 can also be inclined to facilitate advancing the reject material towards its outlet port.

The crushed/sized oil sands material 14 can be fed to one end of the rotary screen ablator 92 and more specifically to the rotary drum 14 through a sealed duct or a conveyor. An ablation solvent 20 is supplied to the rotary drum 14. In some implementations, a portion of the ablation solvent 20 can be sprayed over the tumbling lumps.

The tumbling action of the rotary drum 94 results in lump to lump and lump to screen contact, with the ablation solvent 20 dissolving the bitumen within the lumps, which overall results in the ablation of the crushed/sized oil sands material 14. Depending on the rpm and size of the lump and design of the lifters, some lumps can be lifted and fall on the tumbling material, which can accelerate the ablation. The ablated ore 18 that is fragmented into grain-sized material and smaller lumps having a diameter that is smaller than the screen openings 96 of the rotary drum 94 can pass though the screen openings 96 and accumulate in a bottom section 100 of the horizontally extending cylindrical shell 98.

The ablated ore 18 from the bottom section 100 of the horizontally extending cylindrical shell 98, which can take the form of an heterogenous slurry, can then be supplied to the extraction stage 22. For example, the ablated ore 18 can be gravity-fed or pumped to the extraction stage 22.

The reject material 102 eventually moves towards the other end of the rotary drum 94, i.e., the end that is opposite to where the crushed/sized oil sands material 14 is fed to the rotary screen ablator 92, to be discharged. Wash solvent can be sprayed over the reject material at the outlet port or afterwards to recover solvent diluted bitumen and increase overall bitumen recovery.

Similarly to what is mentioned above regarding the ablator 48 that includes a conveyor 50 as shown in FIGS. 1B, 1C, 4B and 5B, the reject material 102 can then be transported, for instance by gravity or by a conveyer, to a solvent recovery unit, such as a solvent stripping unit, to remove the residual solvent therefrom. The amount of solvent adsorbed on the non-porous reject material 102 can be relatively small and can represent for instance less than about 5 wt %, or less than about 1 wt %, of the reject material 102. As mentioned above, the reject material 102 can be retrieved during the course of the ablation stage 16 and be subjected to solvent recovery to produce a solvent-depleted reject material and reject material recovered solvent. Alternatively, the reject material 102 can be combined with the coarse tailings 30 to form a combined stream of reject material and coarse tailings, and the combined stream of reject material and coarse tailings can be subjected to solvent recovery to produce the tailings-recovered solvent and the solvent-depleted tailings.

An inert gas, such as nitrogen, carbon dioxide, or natural gas can be used to displace oxygen within the rotary screen ablator 92 and prevent air ingress. The rotary screen ablator 92 can be operated at a pressure ranging between about 80 psig to about 120 psig, in which case the rotary screen ablator 92 could be referred to as a pressurized rotary screen ablator 92. Alternatively, the rotary screen ablator 92 can be operated at a pressure slightly above atmospheric pressure, such as about 1 psig to about 15 psig above atmospheric pressure, to control air ingress.

Figure 9:
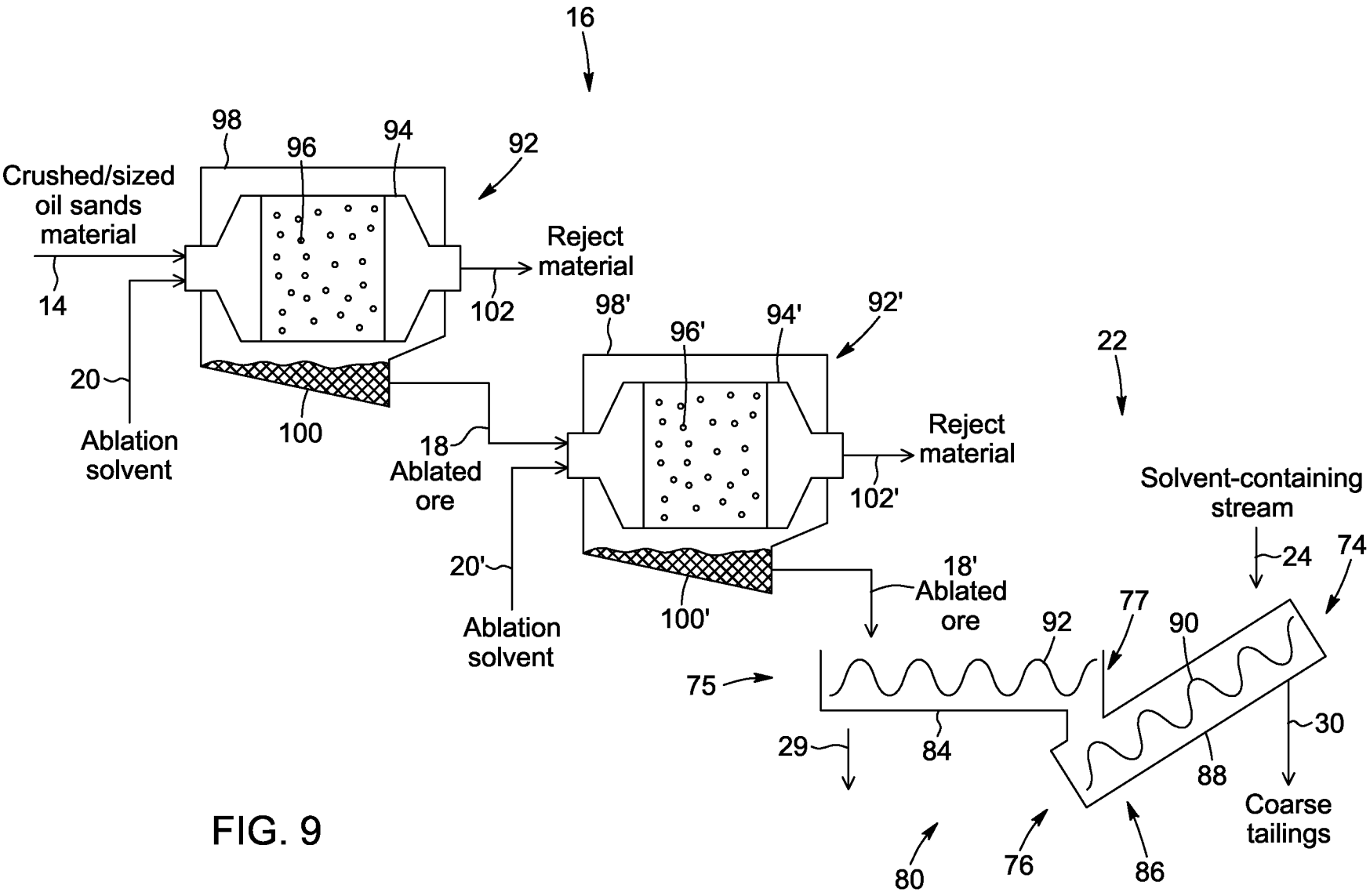
FIG. 9 is a schematic representation of a first and second rotary screen ablators used for performing an ablation stage, the second rotary screen ablator being in fluid communication with an extraction assembly.

FIG. 9 illustrates an implementation where a first and second rotary screen ablators 92, 92' are provided in series. In this implementation, the ablated ore 18 from the first rotary screen ablator 92 is supplied to the second rotary screen ablator 92'. Additional ablation solvent 20' can be supplied to the second rotary screen ablator 92'. In some implementations, the screen openings 96 provided in the rotary drum 94 of the first rotary screen ablator 92 can be larger than the screen openings 96' provided in the rotary drum 94' of the second rotary screen ablator 92'. Such a configuration can enable to enhance controlling the ablation process and the rejects handling. The reject material 102 from the first rotary screen ablator 92 can be combined with the reject material 102' from the second rotary screen ablator 92' to be subjected to solvent recovery as described above. Alternatively, the reject material 102 from the first rotary screen ablator 92 can be subjected to solvent recovery separate from the reject material 102' from the second rotary screen ablator 92'. Wash solvent can be sprayed over the reject material at the outlet port or afterwards to recover solvent diluted bitumen and increase overall bitumen recovery.

Applications of NAE Techniques to Oil Containing Materials

As mentioned above, the NAE methods and systems can be applied for processing bitumen containing materials, such as oil sands ore, to extract bitumen. Various oil sands ores as well as other bitumen and mineral solids containing materials can be processed using NAE.

In some implementations, the oil sands material can be low grade Athabasca oil sands. The NAE process extracts high levels of bitumen regardless of ore grade (within ranges tested). The NAE process can cost effectively extract low grade oil sands. It is estimated that many millions of barrels of bitumen is contained in high fines or high clay ores that are difficult to process using aqueous extraction techniques. The NAE techniques can also process oil sands ores with variable ore grade without the need to significantly modify operating parameters, thus facilitating continuous processing of mined ore regardless of ore grade.

In some implementations, the oil sands material can be oil sands not processable by hot water extraction methods. This technology could be applied to other types of oil sands from other deposits around the world, beyond Canadian oil sands deposits. For example, oil sands from Utah that are not water-wet like Athabasca oil sands and not readily extracted by aqueous processes, could be processed using NAE techniques. Thus, oil-wet oil sands ore could also be processed using NAE.

In some implementations, the material can be contaminated soils such that the NAE process is used for remediation. Hydrocarbon-contaminated soils from spills or leaks and industrial sites (e.g., manufacturing, service and storage) contaminated with leaked liquid hydrocarbons can also be remediated and cleaned up using NAE processes.

ALTERNATIVE IMPLEMENTATIONS

It should also be noted that some units and processes described herein can be used in connection with other types of oil sands processing techniques that can involve the addition of water alone or in combination with solvent. Such techniques, e.g., when solvent is not predominant over water, would not be considered non-aqueous bitumen extraction and can involve adapting the units and processes to water addition and associated handling of aqueous streams. For example, certain integrated extraction units described herein could be adapted for use with aqueous techniques, although equipment sizing, operating parameters including residence time, temperatures, pressures, and the like would be modified compared to non-aqueous extraction.

It is also noted that some implementations described herein can be used for the non-aqueous extraction of other valuable materials from mined ore as well as the treatment and handling of process streams such as minerals and in processes such as extractive metallurgy and oil containing materials or tailings. Of course, the type of solvent, process conditions as well as equipment sizing and design can be adapted for the extraction of other materials.

Several alternative implementations and examples have been described and illustrated herein. The implementations of the technology described above are intended to be exemplary only. A person of ordinary skill in the art would appreciate the features of the individual implementations, and the possible combinations and variations of the components. A person of ordinary skill in the art would further appreciate that any of the implementations could be provided in any combination with the other implementations disclosed herein. It is understood that the technology may be embodied in other specific forms without departing from the central characteristics thereof. The present implementations and examples, therefore, are to be considered in all respects as illustrative and not restrictive, and the technology is not to be limited to the details given herein. Accordingly, while the specific implementations have been illustrated and described, numerous modifications come to mind.

The invention claimed is:

1. A non-aqueous extraction process for producing a bitumen product from an oil sands material comprising bitumen and solid mineral material, comprising:

a preparation treatment comprising at least an ablation stage, the ablation stage comprising:

adding an ablation solvent to the oil sands material to achieve a solvent-to-ore ratio of less than about 10;

mixing the ablation solvent and the sized oil sands material to further reduce the size of the sized oil sands material and produce ablated ore that comprises a mixture of dispersed sands and clay and ablated ore fragments, wherein a majority of the ablated ore fragments has a diameter of less than about 2 inches; and retrieving the ablated ore as a single stream;

subjecting the ablated ore to an extraction stage including adding a solvent-containing stream having a lower boiling point than bitumen to dissolve bitumen present in the ore fragments and facilitate extraction and separation of the bitumen from mineral solids in the ablated ore, thereby producing a solvent diluted bitumen stream comprising bitumen, solvent and fine mineral solids and a solvent diluted tailings stream comprising coarse mineral solids, bitumen and solvent;

separating the fine mineral solids from the solvent diluted bitumen stream to produce a solvent affected fine tailings stream and a bitumen enriched stream, the solvent affected fine tailings stream and the bitumen enriched stream each being substantially depleted in coarse mineral solids; and processing the bitumen enriched stream to produce the bitumen product.

2. The process of claim 1, wherein the ablation solvent comprises an aliphatic solvent or a paraffinic solvent.

3. The process of claim 1, wherein the ablation solvent comprises partially deasphalted bitumen that is recycled from a downstream stage of the non-aqueous extraction process.

4. The process of claim 1, wherein the ablation solvent comprises a recycled stream derived from the solvent diluted bitumen stream.

5. The process of claim 1, further comprising separating reject material from the ablated ore.

6. The process of claim 5, further comprising a reject wash stage to wash the reject material and recover residual bitumen therefrom, the reject wash stage comprising supplying a wash solvent to the reject material to produce recovered residual bitumen and washed reject material.

7. The process of claim 6, wherein the wash reject material comprises residual solvent, and the process further comprises recovering the residual solvent.

8. The process of claim 7, wherein recovering the residual solvent comprises stripping the residual solvent.

9. The process of claim 1, wherein the ablation stage and the extraction stage are performed in a common single unit.

10. The process of claim 9, wherein the common single unit comprises:

a conveyor comprising:

a conveyor trough comprising:

an ablation zone configured for receiving the oil sands material, the ablation zone having an ablation upstream end and an ablation downstream end; and an extraction zone downstream of the ablation zone and in fluid communication therewith, the extraction zone having an extraction upstream end and an extraction downstream end;

a rotating element operatively mounted within and longitudinally along the conveyor trough, the rotating element comprising a shaft couplable to a motor for driving a rotation thereof and a plurality of projections extending outwardly from the shaft;

an oil sands feed inlet for supplying the oil sands material to the ablation zone of the conveyor trough; and a solvent diluted outlet provided at the ablation upstream end for withdrawing a solvent diluted bitumen stream;

wherein the ablated ore travels in a downstream direction to the extraction zone.

11. The process of claim 10, wherein the ablation zone is between about 10% to about 60% of a total length of the conveyor trough.

12. The process of claim 10, wherein the projections extending in the ablation zone and the projections extending in the extraction zone are similarly configured.

13. The process of claim 10, wherein the projections extending in the ablation zone and the projections extending in the extraction zone are configured differently.

14. The process of claim 10, wherein the conveyor is provided as an inclined conveyor in at least one of the ablation zone and the extraction zone.

15. The process of claim 10, wherein the rotating element comprises multiple rotating elements arranged side-by-side relative to each other.

16. The process of claim 1, wherein the ablation stage and the extraction stage are performed in separate units.

17. The process of claim 16, wherein the ablation stage is performed in an ablator that comprises a conveyor, the conveyor comprising:

an ablator trough having an upstream end and a downstream end;

a rotating element operatively mounted within and longitudinally along the ablator trough, the rotating element comprising a shaft and a plurality of projections extending outwardly from the shaft;

a motor system coupled to the at least one rotating element for driving rotation thereof;

an ablated ore outlet for withdrawing the ablated ore; and an oil sands feed inlet for supplying the sized oil sands material to the conveyor.

18. The process of claim 17, wherein the conveyor is operable in a co-current mode, with the ablated ore outlet is provided at the downstream end of the ablator trough and the oil sands feed inlet is provided at the upstream end of the ablator trough, and the ablation solvent is added at least at the upstream end of the ablator trough.

19. The process of claim 17, wherein adding the ablation solvent to the sized oil sands material comprises distributing the ablation solvent over the sized oil sands material along a length of the ablator trough or a section of the length of the ablator trough.

20. The process of claim 16, wherein the ablation stage is performed in an ablator that comprises a rotary screen ablator, the rotary screen ablator comprising:

a rotary drum configured for rotation about a longitudinal axis of the rotary screen ablator, the rotary drum comprising;

a rotary drum chamber having an upstream end and a downstream end; and openings distributed over the rotary drum, the openings being sized for enabling passage of the ablated ore therethrough while reject material remains inside the rotary drum chamber;

a closed cylindrical shell to contain vapours from the ablation solvent therein, the closed cylindrical shell comprising:

a bottom section configured to receive the ablated ore that passed through the openings, the bottom section comprising:

an ablated ore outlet for withdrawing the ablated ore therefrom; and an oil sands feed inlet for supplying the sized oil sands material into the chamber of the rotary drum.

21. The process of claim 20, wherein the ablation solvent is added to the rotary drum by spraying the ablation solvent over tumbling sized oil sands material.

22. The process of claim 20, wherein the ablation solvent is added to the rotary drum at the upstream end thereof, and the reject material is retrieved from the rotary drum from the downstream end thereof.

23. The process of claim 20, wherein the rotary screen ablator is operated at a pressure about 15 psig above atmospheric pressure.

* * * * *